US010877389B2

(12) United States Patent
Kamikura et al.

(10) Patent No.: US 10,877,389 B2
(45) Date of Patent: Dec. 29, 2020

(54) TONER

(71) Applicant: CANON KABUSHIKI KAISHA, Tokyo (JP)

(72) Inventors: Kenta Kamikura, Yokohama (JP); Takashi Matsui, Mishima (JP); Kenji Aoki, Numazu (JP); Masao Suzuki, Kawasaki (JP); Tsutomu Shimano, Mishima (JP); Reo Tagawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,545

(22) Filed: Jun. 12, 2019

(65) Prior Publication Data

US 2019/0384200 A1 Dec. 19, 2019

(30) Foreign Application Priority Data

Jun. 13, 2018 (JP) ..... 2018-113141
Apr. 10, 2019 (JP) ..... 2019-075019

(51) Int. Cl.
*G03G 9/08* (2006.01)
*G03G 9/093* (2006.01)
*G03G 9/087* (2006.01)

(52) U.S. Cl.
CPC ..... *G03G 9/09364* (2013.01); *G03G 9/08795* (2013.01); *G03G 9/08797* (2013.01); *G03G 9/09314* (2013.01); *G03G 9/09321* (2013.01); *G03G 9/09328* (2013.01); *G03G 9/09357* (2013.01); *G03G 9/09392* (2013.01)

(58) Field of Classification Search
CPC ..... G03G 9/09364; G03G 9/09321; G03G 9/09328; G03G 9/09357; G03G 9/09392; G03G 9/09314; G03G 9/08795; G03G 9/08797
USPC ..... 430/108.3, 109.3, 110.2
See application file for complete search history.

(56) References Cited

U.S. PATENT DOCUMENTS 4,960,669 A 10/1990 Mori et al.
7,678,523 B2 3/2010 Hiroko et al.
7,842,446 B2 11/2010 Yanase et al.
7,923,190 B2 4/2011 Magome et al.
7,935,467 B2 5/2011 Dojo et al.
8,426,091 B2 4/2013 Magome et al.
8,426,094 B2 4/2013 Magome et al.
8,603,712 B2 12/2013 Aoki et al.
8,614,044 B2 12/2013 Matsui et al.
8,652,725 B2 2/2014 Watanabe et al.
8,741,519 B2 6/2014 Watanabe et al.
8,778,585 B2 7/2014 Matsui et al.
8,785,101 B2 7/2014 Kaya et al.
8,828,639 B2 9/2014 Kamikura et al.
8,841,054 B2 9/2014 Dojo et al.
8,846,284 B2 9/2014 Kinumatsu et al.
8,883,389 B2 11/2014 Matsui et al.
9,097,997 B2 8/2015 Nomura et al.
9,158,216 B2 10/2015 Shimano et al.
9,213,250 B2 12/2015 Nomura et al.
9,217,943 B2 12/2015 Matsui et al.
9,239,528 B2 1/2016 Hasegawa et al.
9,304,422 B2 4/2016 Matsui et al.
9,309,349 B2 4/2016 Watanabe et al.
9,348,246 B2 5/2016 Magome et al.
9,354,545 B2 5/2016 Matsui et al.
9,377,705 B2 6/2016 Shimano et al.
9,383,668 B2 7/2016 Noji et al.
9,429,860 B2 8/2016 Kinumatsu et al.
9,442,416 B2 9/2016 Magome et al.
9,442,419 B2 9/2016 Wakabayashi et al.
9,500,972 B2 11/2016 Tanaka et al.
9,575,424 B2 2/2017 Nakagawa et al.
9,575,426 B2 2/2017 Shimano et al.
9,581,934 B2 2/2017 Ito et al.
9,599,919 B2 3/2017 Isono et al.
9,625,844 B2 4/2017 Kaya et al.
9,658,546 B2 5/2017 Tanaka et al.
9,658,554 B2 5/2017 Kinumatsu et al.
(Continued)

FOREIGN PATENT DOCUMENTS

EP 0 703 505 3/1996
EP 0 744 668 11/1996
EP 1 494 087 1/2005
EP 2 626 745 8/2013
EP 2 843 473 3/2015
JP 2000-250264 9/2000
(Continued)

OTHER PUBLICATIONS

U.S. Appl. No. 16/438,537, Kentaro Kamae, filed Jun. 12, 2019.
U.S. Appl. No. 16/438,541, Takeshi Hashimoto, filed Jun. 12, 2019.
U.S. Appl. No. 16/438,544, Kazuhisa Shirayama, filed Jun. 12, 2019.
U.S. Appl. No. 16/438,553, Kenji Aoki, filed Jun. 12, 2019.
U.S. Appl. No. 16/438,566, Takashi Matsui, filed Jun. 12, 2019.
U.S. Appl. No. 16/438,605, Daisuke Yoshiba, filed Jun. 12, 2019.
U.S. Appl. No. 16/438,611, Hiroki Kagawa, filed Jun. 12, 2019.
U.S. Appl. No. 16/438,623, Tatsuya Saeki, filed Jun. 12, 2019.
(Continued)

*Primary Examiner* — Mark A Chapman
(74) *Attorney, Agent, or Firm* — Venable LLP

(57) ABSTRACT

The toner has a toner particle in which a toner core containing a binder resin is coated with a shell layer, wherein the binder resin contains a polymer A that has a first monomer unit and a second monomer unit; the first unit is derived from (meth)acrylate ester having an alkyl group having 18 to 36 carbon atoms; the content of the first monomer unit in the polymer is 5.0 to 60.0 mol %; the content of the second monomer unit is 20.0 to 95.0 mol %; the following formula (1) is satisfied when the SP value of the first unit is denoted by $SP_{11}$ and the SP value of the second unit is denoted by $SP_{21}$; and the toner core is coated with a highly uniform shell over at least 90% of the circumference of the toner cross section;

$$3.00 \leq (SP_{21} - SP_{11}) \leq 25.00 \quad (1).$$

13 Claims, No Drawings

(56) References Cited

U.S. PATENT DOCUMENTS

| | | | |
|---|---|---|---|
| 9,785,071 | B2 | 10/2017 | Shimano et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,816 | B2 | 11/2017 | Tanaka et al. |
| 9,835,964 | B2 | 12/2017 | Yoshida et al. |
| 9,857,707 | B2 | 1/2018 | Tsuda et al. |
| 9,857,713 | B2 | 1/2018 | Kosaki et al. |
| 9,869,943 | B2 | 1/2018 | Aoki et al. |
| 9,880,478 | B2 | 1/2018 | Shimano et al. |
| 9,904,195 | B2 | 2/2018 | Matsui et al. |
| 9,921,501 | B2 | 3/2018 | Mochizuki et al. |
| 9,952,523 | B2 | 4/2018 | Shimano et al. |
| 9,958,801 | B2 | 5/2018 | Tanaka et al. |
| 10,012,919 | B2 | 7/2018 | Matsui et al. |
| 10,078,279 | B2 | 9/2018 | Nakagawa et al. |
| 10,101,681 | B2 | 10/2018 | Tagawa et al. |
| 10,114,303 | B2 | 10/2018 | Katsura et al. |
| 10,151,990 | B2 | 12/2018 | Suzuki et al. |
| 10,156,800 | B2 | 12/2018 | Tsuda et al. |
| 10,197,934 | B2 | 2/2019 | Matsui et al. |
| 10,216,107 | B2 | 2/2019 | Tsubaki et al. |
| 10,241,430 | B2 | 3/2019 | Kimura et al. |
| 10,303,074 | B2 | 5/2019 | Yamawaki et al. |
| 10,310,396 | B2 | 6/2019 | Kamikura et al. |
| 10,338,487 | B2 | 7/2019 | Kamikura et al. |
| 10,345,726 | B2 | 7/2019 | Nakamura et al. |
| 10,353,308 | B2 | 7/2019 | Hatakeyama et al. |
| 10,401,750 | B2 | 9/2019 | Nakamura et al. |
| 10,409,180 | B2 | 9/2019 | Koji et al. |
| 2004/0185367 | A1 | 9/2004 | Serizawa et al. |
| 2007/0166636 | A1* | 7/2007 | Daimon ..... G03G 9/08711 430/109.3 |
| 2009/0087768 | A1 | 4/2009 | Tosaka et al. |
| 2009/0197192 | A1 | 8/2009 | Hiroko et al. |
| 2013/0202998 | A1 | 8/2013 | Higashi et al. |
| 2014/0038098 | A1 | 2/2014 | Naka et al. |
| 2014/0272699 | A1 | 9/2014 | Minaki et al. |
| 2014/0308611 | A1 | 10/2014 | Shimano et al. |
| 2015/0185658 | A1 | 7/2015 | Wakabayashi et al. |
| 2017/0045834 | A1 | 2/2017 | Shirai et al. |
| 2017/0269496 | A1 | 9/2017 | Kubo et al. |
| 2018/0143557 | A1 | 5/2018 | Ueda et al. |
| 2018/0329320 | A1 | 11/2018 | Yoshida et al. |
| 2018/0329328 | A1 | 11/2018 | Tanaka et al. |
| 2018/0329332 | A1 | 11/2018 | Tominaga et al. |
| 2019/0137900 | A1 | 5/2019 | Nakagawa et al. |
| 2019/0137901 | A1 | 5/2019 | Shimano et al. |
| 2019/0235403 | A1 | 8/2019 | Tanaka et al. |
| 2019/0235404 | A1 | 8/2019 | Kamikura et al. |
| 2019/0235407 | A1 | 8/2019 | Nakamura et al. |

FOREIGN PATENT DOCUMENTS

| | | |
|---|---|---|
| JP | 2011-094137 | 5/2011 |
| JP | 2013-228724 | 11/2013 |
| JP | 2014-130243 | 7/2014 |
| JP | 2014-142632 | 8/2014 |
| JP | 2014-222259 | 11/2014 |

OTHER PUBLICATIONS

Fedors, "A Method for Estimating Both the Solubility Parameters and Molar Volumes of Liquids", Polymer Engineering and Science, vol. 14, No. 2 (1974) 147-54.

* cited by examiner

TONER

BACKGROUND OF THE INVENTION

Field of the Invention

The present invention relates to the toner employed to develop the electrostatic charge image (electrostatic latent image) used in image-forming methods such as electrophotography, electrostatic printing, and so forth.

Description of the Related Art

Sectors that utilize electrophotography have in recent years expanded to include commercial printing, as represented by package printing and advertising printing, and this has required adaptation to even higher speeds and higher image qualities than have heretofore been required by use in office environments.

In order to accommodate higher speeds, art is known wherein the fixation temperature is lowered through the use of a crystalline resin in the binder resin of the toner. Main-chain crystalline resins, in which the main chain undergoes crystallization, and side-chain crystalline resins, in which the side chains undergo crystallization, are known for crystalline resins. Crystalline polyesters are typical of the former, while long-chain acrylate polymers are typical of the latter. Side-chain crystalline resins in particular are known to exhibit an excellent low-temperature fixability because they facilitate an increase in the crystallinity, and have been widely investigated.

Japanese Patent Application Laid-open No. 2014-130243 discloses a toner that exhibits low-temperature fixability as well as an excellent image stackability, a satisfactory charging behavior, folding strength by the fixed image, and a broad fixable temperature range. This is achieved by coating a shell onto a core that contains a side-chain crystalline resin and by controlling the thermal characteristics of the toner.

Japanese Patent Application Laid-open No. 2014-142632 discloses a toner that exhibits low-temperature fixability as well as an increased image strength. This is achieved by controlling the thermal characteristics of the toner and by coating a shell onto a core that has a sea-island structure in which islands of an amorphous resin are dispersed in a sea of a side-chain crystalline resin.

SUMMARY OF THE INVENTION

On the other hand, in order to raise the image quality, the toner image formed on the drum must be faithfully transferred to paper or an intermediate transfer member. However, the use of large amounts of crystalline resin in the toner binder resin has made it quite difficult to obtain, due to the influence of the charging properties of the binder resin, a toner that exhibits an excellent transferability. It was found that an inferior transferability may also occur with the toners in the patent literature indicated above.

An object of the present invention is to obtain, by improving the transferability of toner that contains a side-chain crystalline resin in the binder resin, a toner that exhibits both an excellent low-temperature fixability and an excellent transferability.

A first aspect in order to solve the aforementioned problem is a toner comprising a toner particle in which a toner core containing a binder resin is coated with a shell layer, wherein the binder resin contains a polymer A that has a first monomer unit derived from a first polymerizable monomer and a second monomer unit derived from a second polymerizable monomer that is different from the first polymerizable monomer;

the first polymerizable monomer is at least one selected from the group consisting of (meth)acrylate esters having an alkyl group having 18 to 36 carbon atoms;

the content of the first monomer unit in the polymer A is 5.0 mol % to 60.0 mol % with reference to the total number of moles of all the monomer units in the polymer A;

the content of the second monomer unit in the polymer A is 20.0 mol % to 95.0 mol % with reference to the total number of moles of all the monomer units in the polymer A;

the following formula (1) is satisfied when the SP value of the first monomer unit is denoted by $SP_{11}$ $(J/cm^3)^{0.5}$ and the SP value of the second monomer unit is denoted by $SP_{21}$ $(J/cm^3)^{0.5}$, $$3.00 \leq (SP_{21} - SP_{11}) \leq 25.00 \quad (1);$$

the shell layer is observed over at least 90% of the circumference of the toner cross section in an image of the toner cross section observed with a transmission electron microscope (TEM);

the shell layer is constituted of at least one amorphous resin selected from the group consisting of homopolymers, alternating copolymers, and random copolymers; and the following formula (2) is satisfied when the shell layer is constituted of two or more amorphous resins, wherein the resin having the highest SP value of the resins constituting the shell layer is designated as resin S1, the resin having the lowest SP value of the resins constituting the shell layer is designated as resin S2, the SP value of the resin S1 is denoted by $SP_{S1}$ $(J/cm^3)^{0.5}$, and the SP value of the resin S2 is denoted by $SP_{S2}$ $(J/cm^3)^{0.5}$, $$SP_{S1} - SP_{S2} \leq 3.0 \quad (2).$$

A second aspect in order to solve the aforementioned problem is a toner comprising a toner particle in which a toner core containing a binder resin is coated with a shell layer, wherein the binder resin contains a polymer A that is a polymer of a composition containing a first polymerizable monomer and a second polymerizable monomer that is different from the first polymerizable monomer;

the first polymerizable monomer is at least one selected from the group consisting of (meth)acrylate esters having an alkyl group having 18 to 36 carbon atoms;

the content of the first polymerizable monomer in the composition is 5.0 mol % to 60.0 mol % with reference to the total number of moles of all the polymerizable monomer in the composition;

the content of the second polymerizable monomer in the composition is 20.0 mol % to 95.0 mol % with reference to the total number of moles of all the polymerizable monomer in the composition;

the following formula (3) is satisfied when the SP value of the first polymerizable monomer is denoted by $SP_{12}$ $(J/cm^3)^{0.5}$ and the SP value of the second polymerizable monomer is denoted by $SP_{22}$ $(J/cm^3)^{0.5}$, $$0.60 \leq (SP_{22} - SP_{12}) \leq 15.00 \quad (3);$$

the shell layer is observed over at least 90% of the circumference of the toner cross section in an image of the toner cross section observed with a transmission electron microscope (TEM);

the shell layer is constituted of at least one amorphous resin selected from the group consisting of homopolymers, alternating copolymers, and random copolymers; and the following formula (2) is satisfied when the shell layer is constituted of two or more amorphous resins, wherein the resin having the highest SP value of the resins constituting the shell layer is designated as resin S1, the resin having the lowest SP value of the resins constituting the shell layer is designated as resin S2, the SP value of the resin S1 is denoted by $SP_{S1}$ $(J/cm^3)^{0.5}$, and the SP value of the resin S2 is denoted by $SP_{S2}$ $(J/cm^3)^{0.5}$, $$SP_{S1}-SP_{S2}\leq 3.0 \quad (2).$$

The present invention can thus provide a toner that exhibits both an excellent low-temperature fixability and an excellent transferability.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

In the present invention, "(meth)acrylate ester" means acrylate ester and/or methacrylate ester.

With regard to the "monomer unit" in the present invention, one unit is taken to be one carbon-carbon bond segment in a main chain provided by the polymerization of vinyl monomer into polymer.

The vinyl monomer can be represented by the following formula (C).

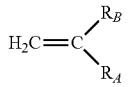

(C)

[Where, $R_A$ represents a hydrogen atom or alkyl group (preferably an alkyl group having 1 to 3 carbon atoms and more preferably the methyl group) and $R_B$ represents any substituent.]

A "crystalline resin" denotes a resin that displays a distinct endothermic peak in measurement by differential scanning calorimetry (DSC).

The first aspect of the present invention is a toner comprising a toner particle in which a toner core containing a binder resin is coated with a shell layer, wherein the binder resin contains a polymer A that has a first monomer unit derived from a first polymerizable monomer and a second monomer unit derived from a second polymerizable monomer that is different from the first polymerizable monomer;

the first polymerizable monomer is at least one selected from the group consisting of (meth)acrylate esters having an alkyl group having 18 to 36 carbon atoms;

the content of the first monomer unit in the polymer A is 5.0 mol % to 60.0 mol % with reference to the total number of moles of all the monomer units in the polymer A;

the content of the second monomer unit in the polymer A is 20.0 mol % to 95.0 mol % with reference to the total number of moles of all the monomer units in the polymer A;

the following formula (1) is satisfied when the SP value of the first monomer unit is denoted by $SP_{11}$ $(J/cm^3)^{0.5}$ and the SP value of the second monomer unit is denoted by $SP_{21}$ $(J/cm^3)^{0.5}$, $$3.00\leq(SP_{21}-SP_{11})\leq 25.00 \quad (1);$$

the shell layer is observed over at least 90% of the circumference of the toner cross section in an image of the toner cross section observed with a transmission electron microscope (TEM);

the shell layer is constituted of at least one amorphous resin selected from the group consisting of homopolymers, alternating copolymers, and random copolymers; and the following formula (2) is satisfied when the shell layer is constituted of two or more amorphous resins, wherein the resin having the highest SP value of the resins constituting the shell layer is designated as resin S1, the resin having the lowest SP value of the resins constituting the shell layer is designated as resin S2, the SP value of the resin S1 is denoted by $SP_{S1}$ $(J/cm^3)^{0.5}$, and the SP value of the resin S2 is denoted by $SP_{S2}$ $(J/cm^3)^{0.5}$, $$SP_{S1}-SP_{S2}\leq 3.0 \quad (2).$$

The second aspect of the present invention is a toner comprising a toner particle in which a toner core containing a binder resin is coated with a shell layer, wherein the binder resin contains a polymer A that is a polymer of a composition containing a first polymerizable monomer and a second polymerizable monomer that is different from the first polymerizable monomer;

the first polymerizable monomer is at least one selected from the group consisting of (meth)acrylate esters having an alkyl group having 18 to 36 carbon atoms;

the content of the first polymerizable monomer in the composition is 5.0 mol % to 60.0 mol % with reference to the total number of moles of all the polymerizable monomer in the composition;

the content of the second polymerizable monomer in the composition is 20.0 mol % to 95.0 mol % with reference to the total number of moles of all the polymerizable monomer in the composition;

the following formula (3) is satisfied when the SP value of the first polymerizable monomer is denoted by $SP_{12}$ $(J/cm^3)^{0.5}$ and the SP value of the second polymerizable monomer is denoted by $SP_{22}$ $(J/cm^3)^{0.5}$, $$0.60\leq(SP_{22}-SP_{12})\leq 15.00 \quad (3);$$

the shell layer is observed over at least 90% of the circumference of the toner cross section in an image of the toner cross section observed with a transmission electron microscope (TEM);

the shell layer is constituted of at least one amorphous resin selected from the group consisting of homopolymers, alternating copolymers, and random copolymers; and the following formula (2) is satisfied when the shell layer is constituted of two or more amorphous resins, wherein the resin having the highest SP value of the resins constituting the shell layer is designated as resin S1, the resin having the lowest SP value of the resins constituting the shell layer is designated as resin S2, the SP value of the resin S1 is denoted by $SP_{S1}$ $(J/cm^3)^{0.5}$, and the SP value of the resin S2 is denoted by $SP_{S2}$ $(J/cm^3)^{0.5}$, $$SP_{S1}-SP_{S2}\leq 3.0 \quad (2).$$

The present inventors hypothesize as follows with regard to the factors that make it possible for the aforementioned constitution to provide a toner having both an excellent low-temperature fixability and an excellent transferability.

A factor underlying the difficulty of having the low-temperature fixability co-exist with the transferability in crystalline resin-containing toners is that crystalline resins have a lower resistance value than amorphous resins. Using a process having an intermediate transfer member as an example, when the resistance assumes a low value, leakage of the charge held by the toner is then facilitated due to the effect of the potential difference in those steps where the toner is transported using a potential difference, e.g., development and primary transfer. As a consequence, in many cases the toner will not maintain a satisfactory charge in the final secondary transfer step and the responsiveness to the transfer current ends up declining, which is associated with a decline in the transferability.

Even in processes that do not have a secondary transfer step, the influence of charge leakage in the development step may similarly be associated with a decline in transferability in the primary transfer step.

In order to improve the charging performance, a core comprising a crystalline resin or a core comprising a sea-island structure of a crystalline resin and an amorphous resin is coated with a shell in the toners in the patent literature indicated above. Doing this serves to improve the charge retention during standing at quiescence after charging. However, it was found that this is not adequate for charge retention in steps such as development and primary transfer. The cause of this is that the low-resistance crystalline segments form a pure continuous phase, and as a consequence the charge held by the shell layer ends up leaking via the crystalline segments.

The Japanese Patent Application Laid-open No. 2014-130243 also discloses a toner containing a resin obtained by the copolymerization of a long-chain alkyl acrylate, which is a monomer that forms a crystalline segment, with acrylic acid, which is a highly polar monomer. However, due to the small amount of the highly polar monomer in this toner, phase separation between the crystalline segments and highly polar portions is inadequate. As a result, the resistance of the resin as a whole ends up declining, and it was found that leakage in steps such as development and primary transfer similarly could not be inhibited.

Based on the preceding, it is thought that the following would be effective for inhibiting charge leakage in steps such as development and primary transfer: phase separation between crystalline segments and amorphous segments, and the use of a resin with which the crystalline segments do not form a pure continuous phase.

As a result of intensive investigations, the present inventors have now discovered that an excellent transferability is exhibited by a toner that uses a polymer A having, in prescribed proportions, both a monomer unit derived from (meth)acrylate ester having an alkyl group having 18 to 36 carbon atoms and a monomer unit having an SP value that is sufficiently distant from the aforementioned monomer unit.

With the polymer A, because the SP values of these two monomer units are sufficiently distant from one another and because both monomer units are present in sufficient amounts, the two monomer units are not compatible with each other and can be present phase-separated from each other. On the other hand, because the two monomer units are present in one and the same molecule, a pure continuous phase cannot be formed by the crystalline segments containing the monomer unit derived from at least one selected from the group consisting of (meth)acrylate esters having an alkyl group having 18 to 36 carbon atoms.

As a consequence, it is believed that the crystalline segments and amorphous segments, while undergoing phase separation, also readily assume an intricately entangled microphase-separated structure. The present inventors hypothesize that leakage is inhibited with polymer A because the low-resistance crystalline segments and high-resistance amorphous segments assume an intricately entangled microphase-separated structure.

That is, the polymer A preferably has a crystalline segment containing a first monomer unit derived from a first polymerizable monomer. The polymer A preferably also has an amorphous segment containing a second monomer unit derived from a second polymerizable monomer.

In addition, in order to obtain the polymer A, a (meth) acrylate ester having an alkyl group having 18 to 36 carbon atoms is preferably copolymerized with a monomer that has an SP value sufficiently distant from that for this (meth) acrylate ester. As a consequence of this, the monomers do not uniformly mix with each other during polymerization and the generation is then facilitated of a block copolymer-like structure in which crystalline segments and amorphous segments are separated. Through the assumption of a block copolymer-like structure, the crystallinity of the crystalline segments is enhanced and in addition the assumption of the aforementioned microphase-separated structure is facilitated.

Thus, a toner comprising the polymer A has an excellent transferability; however, as a result of investigations, it was confirmed that merely having the polymer A as binder resin does not provide a satisfactory improvement in the transferability after long-term use. The present inventors therefore carried out investigations directed to additional improvements.

Within this context the present inventors focused on the attachment forces in toners. A toner containing the polymer A does provide an excellent suppression of charge leakage; however, the toner particle surface is considered to be nonuniform because the toner particle surface has a microphase-separated structure. Toners are generally obtained by adding, e.g., an inorganic fine powder, as an external additive to the toner particle surface, and the charging performance of the toner surface is made uniform by the function thereof. However, due to changes in the state of attachment of the external additive during long-term use, exposure of the resin at the toner particle surface increases and the influence of the charge uniformity of the toner particle surface becomes prominent.

When the toner particle surface has a nonuniform structure in which crystalline segments and amorphous segments are phase separated, during charging the charge concentrates at the high-polarity amorphous segments and as a consequence the toner's electrostatic attachment force increases. In addition, since the crystalline segments more nearly resemble a viscous body than do the amorphous segments, the non-electrostatic attachment forces are also increased by exposure of the crystalline segments. A toner that exhibits high attachment forces will readily attach to members of, e.g., the electrostatic latent image bearing member, intermediate transfer member, and so forth, during the transfer step, and the transferability will decline as a result.

The present inventors thus discovered that the aforementioned problem could be solved by coating a toner core having a nonuniform surface having the polymer A, with a shell constituted of an amorphous resin having a uniform composition and structure. The present invention was achieved as a result of this discovery.

The first polymerizable monomer is at least one selected from the group consisting of (meth)acrylate esters having an alkyl group having 18 to 36 carbon atoms.

The (meth)acrylate esters having an alkyl group having 18 to 36 carbon atoms can be exemplified by (meth)acrylate esters having a linear alkyl group having 18 to 36 carbon atoms [e.g., stearyl (meth)acrylate, nonadecyl (meth)acrylate, eicosyl (meth)acrylate, heneicosyl (meth)acrylate, behenyl (meth)acrylate, lignoceryl (meth)acrylate, ceryl (meth)acrylate, octacosyl (meth)acrylate, myricyl (meth) acrylate, and dotriacontyl (meth)acrylate] and by (meth) acrylate esters having a branched alkyl group having 18 to 36 carbon atoms [e.g., 2-decyltetradecyl (meth)acrylate].

In terms, more particularly, of the transferability and low-temperature fixability of the toner, at least one selected from the group consisting of (meth)acrylate esters having a linear alkyl group having 18 to 36 carbon atoms is preferred; at least one selected from the group consisting of (meth) acrylate esters having a linear alkyl group having 18 to 30 carbon atoms is more preferred; and at least one selected from the group consisting of linear stearyl (meth)acrylate and linear behenyl (meth)acrylate is even more preferred.

In the first aspect, the content of the first monomer unit in the polymer A is 5.0 mol % to 60.0 mol % with reference to the total number of moles of all the monomer units in the polymer A.

In the second aspect, the polymer A is a polymer of a composition that contains a first polymerizable monomer and a second polymerizable monomer that is different from the first polymerizable monomer. The content of the first polymerizable monomer in the composition is 5.0 mol % to 60.0 mol % with reference to the total number of moles of all the polymerizable monomer in the composition.

When the contents are in the indicated range, the crystallinity of the crystalline segments in polymer A is increased and accompanying this phase separation from the amorphous segments is promoted. As a consequence, a toner can be obtained that has an excellent transferability and an excellent low-temperature fixability. This content is preferably 10.0 mol % to 60.0 mol % and is more preferably 20.0 mol % to 40.0 mol %.

When, on the other hand, the content is less than 5.0 mol %, little crystalline segment is present and as a consequence a toner having a satisfactory low-temperature fixability may not be obtained. In addition, due to the presence of little crystalline segment, it becomes difficult to increase the crystallinity of the resin and phase separation from the amorphous regions may be ill-defined. When, in contrast, the content exceeds 60.0 mol %, the crystalline segments are present in large amounts and as a consequence the suppression of charge leakage is impaired and toner having a satisfactory transferability may not be obtained.

When the polymer A in the present invention contains a plurality of species of monomer units that satisfy the requirements for the aforementioned first monomer unit, the value provided by the weighted-averaging of the SP values of each of these monomer units is used for the value of $SP_{11}$ in formula (1). For example, the SP value ($SP_{11}$) is $$SP_{11}=(SP_{111}\times A+SP_{112}\times(100-A))/100$$

when a monomer unit A having an SP value of $SP_{111}$ is contained at A mol % with reference to the number of moles of all the monomer units that satisfy the requirements for the first monomer unit and a monomer unit B having an SP value of $SP_{112}$ is contained at (100−A) mol % with reference to the number of moles of all the monomer units that satisfy the requirements for the first monomer unit. The calculations are similarly performed when three or more monomer units that satisfy the requirements for the first monomer unit are incorporated. $SP_{12}$, on the other hand, also represents the average value similarly calculated using the molar ratios of the respective first polymerizable monomers.

In addition, when a plurality of first monomer units are present, the content of the first monomer unit is then the sum of the contents of each individual monomer unit. This similarly applies when a plurality of first polymerizable monomers are present.

In the first aspect, the content of the second monomer unit in the polymer A is 20.0 mol % to 95.0 mol % with reference to the total number of moles of all the monomer units in the polymer A.

In the second aspect, the content of the second polymerizable monomer in the composition is 20.0 mol % to 95.0 mol % with reference to the total number of moles of all the polymerizable monomer in the composition.

When the contents are in the indicated ranges, a satisfactory phase separation between the crystalline segments and amorphous segments can be brought about and a toner having an excellent transferability can then be obtained.

The contents are preferably 40.0 mol % to 95.0 mol % and more preferably 40.0 mol % to 70.0 mol %.

When, on the other hand, the content is less than 20.0 mol %, the suppression of charge leakage is then impaired because compatibility between the crystalline segments and amorphous segments is facilitated. As a consequence, toner having a satisfactory transferability may not be obtained. When, conversely, the content exceeds 95.0 mol %, relatively little crystalline segment is present and as a consequence toner having a satisfactory low-temperature fixability may not be obtained. In addition, due to the relatively small amount of crystalline segment, it is difficult for the crystallinity of the resin to increase and the melting point may decline.

$SP_{11}$ and $SP_{21}$ satisfy the following formula (1) in the first aspect when the SP value of the first monomer unit is denoted by $SP_{11}$ $(J/cm^3)^{0.5}$ and the SP value of the second monomer unit is denoted by $SP_{21}$ $(J/cm^3)^{0.5}$.

$$3.00\leq(SP_{21}-SP_{11})\leq25.00 \quad (1)$$

The following formula (3) is satisfied in the second aspect for the polymer A when the SP value of the first polymerizable monomer is denoted by $SP_{12}$ $(J/cm^3)^{0.5}$ and the SP value of the second polymerizable monomer is denoted by $SP_{22}$ $(J/cm^3)^{0.5}$.

$$0.60\leq(SP_{22}-SP_{12})\leq15.00 \quad (3)$$

When the differences in the SP values are in the indicated ranges, a satisfactory phase separation between the crystalline segments and amorphous segments can be brought about and a toner having an excellent transferability can then be obtained. $SP_{21}-SP_{11}$ is preferably at least 4.00 and is more preferably at least 5.00. When $SP_{21}-SP_{11}$ is in the indicated range, phase separation between the crystalline segments and amorphous segments becomes better defined and the transferability is improved. $SP_{21}-SP_{11}$ is preferably not more than 20.00 and is more preferably not more than 15.00. When $SP_{21}-SP_{11}$ is in the indicated range, the development of compatibility between the crystalline segments and amorphous segments during fixing is facilitated and a toner can then be obtained that exhibits a satisfactory low-temperature fixability even in faster fixing processes.

Similarly, $SP_{22}-SP_{12}$ is preferably at least 2.00 and is more preferably at least 3.00. $SP_{22}-SP_{12}$ is also preferably not more than 10.00 and is more preferably not more than 7.00.

When, on the other hand, the differences in the SP values are less than the lower limits, phase separation between the crystalline segments and amorphous segments then becomes inadequate and a toner having a satisfactory transferability may not be obtained. When the differences in the SP values exceed the upper limits, the crystalline segments do not compatibilize into the amorphous segments even during fixing, and as a consequence a toner having a satisfactory low-temperature fixability may not be obtained.

The method for calculating the SP value is described below. In the present invention, the second monomer unit applies to all monomer units having an $SP_{21}$ that satisfies formula (1) with respect to $SP_{11}$ as calculated by this method. Similarly, the second polymerizable monomer applies to all polymerizable monomers having an $SP_{22}$ that satisfies formula (3) with respect to $SP_{12}$ as calculated by this method.

That is, when the second polymerizable monomer is two or more species of polymerizable monomers, $SP_{21}$ represents the SP value of the monomer unit derived from each polymerizable monomer and $SP_{21}-SP_{11}$ is determined for the monomer unit derived from each second polymerizable monomer. Similarly, $SP_{22}$ represents the SP value of each polymerizable monomer and $SP_{22}-SP_{12}$ is determined for each second polymerizable monomer.

The content of the second monomer unit is the sum of the contents of all the monomer units that satisfy the condition given above. The same also applies when a plurality of second polymerizable monomers are present.

The polymerizable monomers provided as examples below can be used as the second polymerizable monomer when the particular polymerizable monomer satisfies formula (1) or formula (3).

A single second polymerizable monomer may be used by itself or two or more may be used in combination.

Examples of nitrile group-bearing monomers are acrylonitrile and methacrylonitrile.

Examples of hydroxy group-bearing monomers are 2-hydroxyethyl (meth)acrylate and 2-hydroxypropyl (meth)acrylate.

Examples of amide group-bearing monomers are acrylamide and monomers provided by reaction by a known method between an amine having 1 to 30 carbon atoms and a carboxylic acid having 2 to 30 carbon atoms and containing an ethylenically unsaturated bond (e.g., acrylic acid, methacrylic acid).

Examples of urethane group-bearing monomers are monomers provided by the reaction by a known method between an alcohol having 2 to 22 carbon atoms and containing an ethylenically unsaturated bond (e.g., 2-hydroxyethyl methacrylate, vinyl alcohol, and so forth) and an isocyanate having 1 to 30 carbon atoms [e.g., a monoisocyanate compound (e.g., benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, and 2,6-dipropylphenyl isocyanate), aliphatic diisocyanate compound (e.g., trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, and 2,4,4-trimethylhexamethylene diisocyanate), alicyclic diisocyanate compound (e.g., 1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, and hydrogenated tetramethylxylylene diisocyanate), or aromatic diisocyanate compound (e.g., phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate, and xylylene diisocyanate)], and monomers provided by the reaction by a known method between an alcohol having 1 to 26 carbon atoms (e.g., methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, and erucyl alcohol) and an isocyanate having 2 to 30 carbon atoms and containing an ethylenically unsaturated bond [e.g., 2-isocyanatoethyl (meth)acrylate, 2-(O-[1'-methylpropylideneamino]carboxyamino)ethyl (meth)acrylate, 2-[(3,5-dimethylpyrazolyl)carbonylamino]ethyl (meth)acrylate, and 1,1-(bis(meth)acryloyloxymethyl)ethyl isocyanate].

Examples of urea group-bearing monomers are monomers provided by the reaction by a known method of an amine having 3 to 22 carbon atoms [e.g., primary amines (normal-butylamine, t-butylamine, propylamine, and isopropylamine), secondary amines (e.g., di-normal-ethylamine, di-normal-propylamine, and di-normal-butylamine), aniline, and cyclohexylamine] with an isocyanate having 2 to 30 carbon atoms and an ethylenically unsaturated bond.

Examples of carboxy group-bearing monomers are methacrylic acid, acrylic acid, and 2-carboxyethyl (meth)acrylate.

Among the preceding, the use is preferred of monomer bearing a nitrile group, amide group, urethane group, hydroxy group, or urea group. The monomer more preferably has an ethylenically unsaturated bond and at least one functional group selected from the group consisting of the nitrile group, amide group, urethane group, hydroxy group, and urea group. The use of these monomers serves to facilitate the maintenance of a low resistance value by the polymer even at high humidities. As a consequence, a toner having an excellent transferability even at high humidities is readily obtained, which is preferred.

Vinyl esters, e.g., vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate, and vinyl octylate, are also preferably used as the second polymerizable monomer. Vinyl esters are nonconjugated monomers and have a relatively low reactivity with the first polymerizable monomer, which is a conjugated monomer, and due to this the promotion of phase separation between the first monomer unit and the second monomer unit is facilitated. The generation of toner having an excellent transferability is therefore facilitated.

In addition, when a vinyl ester is used as the second polymerizable monomer, the reactivity contributes, in addition to the difference in SP values, to phase separation. Due to this, if $SP_{21}-SP_{11}$, $SP_{22}-SP_{12}$, and the content of the first polymerizable monomer are within the ranges according to the present invention, even when these items are outside the preferred ranges a phase separation behavior equal to that within the preferred ranges can be obtained and toner having an excellent transferability is readily obtained.

The second polymerizable monomer preferably has an ethylenically unsaturated bond and more preferably has one ethylenically unsaturated bond.

In addition, the second polymerizable monomer is preferably at least one selected from the group consisting of the following formulas (A) and (B).

(A)

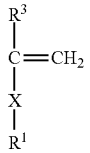

(B)

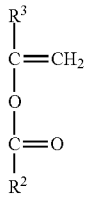

(Where, X represents a single bond or an alkylene group having 1 to 6 carbon atoms.

$R^1$ is a nitrile group (—C≡N),
amide group (—C(=O)NHR$^{10}$ ($R^{10}$ is a hydrogen atom or an alkyl group having 1 to 4 carbon atoms)),
hydroxy group,
—COOR$^{11}$ ($R^{11}$ is an alkyl group having 1 to 6 (preferably 1 to 4) carbon atoms or a hydroxyalkyl group having 1 to 6 (preferably 1 to 4) carbon atoms),
urethane group (—NHCOOR$^{12}$ ($R^{12}$ is an alkyl group having 1 to 4 carbon atoms)),
urea group (—NH—C(=O)—N$(R^{13})_2$ ($R^{13}$ each independently is a hydrogen atom or an alkyl group having 1 to 6 (preferably 1 to 4) carbon atoms)),
—COO$(CH_2)_2$NHCOOR$^{14}$ ($R^{14}$ is an alkyl group having 1 to 4 carbon atoms), or —COO$(CH_2)_2$—NH—C(=O)—N$(R^{15})_2$ ($R^{15}$ each independently is a hydrogen atom or an alkyl group having 1 to 6 (preferably 1 to 4) carbon atoms).

$R^1$ is preferably a nitrile group (—C≡N),
amide group (—C(=O)NHR$^{10}$ ($R^{10}$ is a hydrogen atom or an alkyl group having 1 to 4 carbon atoms)),
hydroxy group,
—COOR$^{11}$ ($R^{11}$ is an alkyl group having 1 to 6 (preferably 1 to 4) carbon atoms or a hydroxyalkyl group having 1 to 6 (preferably 1 to 4) carbon atoms),
urea group (—NH—C(=O)—N$(R^{13})_2$ ($R^{13}$ each independently is a hydrogen atom or an alkyl group having 1 to 6 (preferably 1 to 4) carbon atoms)),
—COO$(CH_2)_2$NHCOOR$^{14}$ ($R^{14}$ is an alkyl group having 1 to 4 carbon atoms), or —COO$(CH_2)_2$—NH—C(=O)—N$(R^{15})_2$ ($R^{15}$ each independently is a hydrogen atom or an alkyl group having 1 to 6 (preferably 1 to 4) carbon atoms).

$R^2$ is an alkyl group having 1 to 4 carbon atoms and $R^3$ each independently is a hydrogen atom or methyl group.)

The polymer A is preferably a vinyl polymer. Vinyl polymers are, for example, polymers of monomer that contains an ethylenically unsaturated bond. An ethylenically unsaturated bond indicates a carbon-carbon double bond that is capable of undergoing radical polymerization, and can be exemplified by the vinyl group, propenyl group, acryloyl group, and methacryloyl group.

The acid value of the polymer A is preferably not more than 30 mg KOH/g and is more preferably not more than 20 mg KOH/g. Maintaining a low resistance value for the polymer even at high humidities is facilitated by having the acid value be in the indicated range. A toner exhibiting an excellent transferability even at high humidities is then readily obtained. The lower limit on this acid value is not particularly limited, but equal to or greater than 0 mg KOH/g is preferred. The acid value can be controlled through the type and quantity of addition of the polymerizable monomer.

The polymer A may contain, within a range that preserves the aforementioned molar ratios for the first monomer unit derived from the first polymerizable monomer and the second monomer unit derived from the second polymerizable monomer, a third monomer unit derived from a third polymerizable monomer not encompassed in the range of the aforementioned formula (1) or formula (3) (that is, different from the first polymerizable monomer and different from the second polymerizable monomer).

Monomers that do not satisfy formula (1) or formula (3) from among the monomers described above in the section on the second polymerizable monomer, can be used as the third polymerizable monomer.

The following monomers, which do not contain the aforementioned nitrile group, amide group, urethane group, hydroxy group, urea group, or carboxy group, can also be used.

Examples are styrene and its derivatives, such as styrene and o-methylstyrene, and (meth)acrylate esters such as methyl (meth)acrylate, n-butyl (meth)acrylate, t-butyl (meth)acrylate, and 2-ethylhexyl (meth)acrylate. Among these, at least one selected from the group consisting of styrene, methyl methacrylate, and methyl acrylate is preferred.

These monomers do not contain a polar group and thus have low SP values, making it difficult for them to satisfy formula (1) or formula (3). However, when they do satisfy formula (1) or formula (3), they can be used as a second polymerizable monomer.

By satisfying the conditions given above, a polymer can be obtained that has a low resistance value while maintaining crystallinity. As a consequence, a toner can be obtained that exhibits both an excellent low-temperature fixability and an excellent transferability.

The charge decay constant can be used as an index for the resistance value. The charge decay constant of the polymer A is preferably not more than 100. Charge leakage is impeded in this range. This facilitates obtaining a toner having an excellent transferability. The charge decay constant of the polymer A is more preferably from 1 to 50. This range is more preferred because it enables suppression of overcharging through toner-to-toner charge delivery, while providing additional suppression of charge leakage. The charge decay constant of the polymer A can be controlled through the type and amount of addition of the polymerizable monomer.

The endothermic quantity for an endothermic peak can be used as an index for the crystallinity. From the standpoint of the low-temperature fixability, the endothermic quantity for the endothermic peak associated with the melting of the polymer A is preferably 20 (J/g) to 100 (J/g). This endothermic quantity is more preferably 30 (J/g) to 80 (J/g). This endothermic quantity can be controlled through the amount of addition of the first monomer unit or first polymerizable monomer.

The shell layer is observed over at least 90% of the circumference of the toner cross section in an image of the toner cross section observed with a transmission electron microscope (TEM) (the percentage over which the shell layer is observed on the circumference is also referred to as the coverage ratio in the following). In this case, and in combination with the conditions described below being satisfied, the surface of the toner particle becomes satisfactorily uniform and toner having an excellent transferability can be obtained. The shell layer is preferably observed over at least 95% of the circumference of the toner cross section. When, on the other hand, the shell layer is observed only over less than 90% of the circumference of the toner cross section, the uniformity of the toner particle surface becomes inadequate and a toner having a satisfactory transferability may not be obtained.

The upper limit is not particularly limited, but the coverage ratio is preferably equal to or less than 100% and is more preferably equal to or less than 99.5%.

The coverage ratio can be controlled through the amount of addition and method of addition for the material that forms the shell layer.

The shell layer is constituted of at least one amorphous resin selected from the group consisting of homopolymers, alternating copolymers, and random copolymers. In this case, the toner particle surface becomes satisfactorily uniform and toner having an excellent transferability can be obtained. Homopolymers and alternating copolymers provide an excellent uniformity and are thus preferred.

For the present invention, and regardless of the particular type of polymer, a homopolymer refers to a polymer constituted of only a monomer unit derived from a single monomer; an alternating copolymer refers to a polymer in which monomer units derived from two species of monomers are disposed in alternation; and a random copolymer refers to a polymer in which monomer units derived from two or more species of monomers are arranged in a manner lacking regularity.

For example, a polymer obtained by the condensation polymerization of a single hydroxy acid is a homopolymer, while a resin obtained by the condensation polymerization of a single diol and a single dicarboxylic acid is an alternating copolymer. A resin obtained by the simultaneous condensation polymerization of two diols and two carboxylic acids is a random copolymer when the reactivities of the monomers with each other are not substantially different.

Thermosetting resins having a network crosslinked structure may also be similarly classified insofar as the preceding conditions are satisfied. For example, a silicone resin obtained by the condensation polymerization of a single alkylsilane is a homopolymer, while a melamine resin obtained by the condensation polymerization of melamine and formaldehyde is an alternating copolymer.

When, on the other hand, the shell layer is constituted of, e.g., a block copolymer or graft copolymer not complying with the preceding, phase separation of the respective monomer units then readily occurs at the toner particle surface and the uniformity of the toner particle surface becomes unsatisfactory as a consequence and a toner having a satisfactory transferability may not be obtained. In addition, when the shell layer is constituted of a crystalline resin, the shell layer then ends up leaking charge and a toner having a satisfactory transferability may not be obtained as a consequence.

The amorphous resin used for the shell layer should be a homopolymer, alternating copolymer, or random copolymer, but is not otherwise particularly limited, and heretofore known amorphous resins may be used.

In specific terms, polyester resins, polyurethane resins, polyamide resins, and vinyl resins are examples of thermoplastic resins, while melamine resins and urea resins are examples of thermosetting resins. At least one selected from the group consisting of polyester resins, polyurethane resins, melamine resins, vinyl resins, and urea resins is preferred because this provides an excellent phase separation behavior from the toner core and because this facilitates obtaining an alternating copolymer and facilitates bringing the toner particle surface into a uniform state.

The polyester resin can be obtained by the reaction of at least a dibasic polybasic carboxylic acid with a polyhydric alcohol.

The following compounds are examples of polybasic carboxylic acids: dibasic acids such as succinic acid, adipic acid, sebacic acid, phthalic acid, isophthalic acid, terephthalic acid, malonic acid, and dodecenylsuccinic acid, and their anhydrides and lower alkyl esters, and aliphatic unsaturated dicarboxylic acids such as maleic acid, fumaric acid, itaconic acid, and citraconic acid as well as 1,2,4-benzenetricarboxylic acid and 1,2,5-benzenetricarboxylic acid and their anhydrides and lower alkyl esters. A single one of these may be used by itself or two or more may be used in combination.

The polyhydric alcohol can be exemplified by the following compounds:

alkylene glycols (ethylene glycol, 1,2-propylene glycol, and 1,3-propylene glycol), alkylene ether glycols (polyethylene glycol and polypropylene glycol), alicyclic diols (1,4-cyclohexanedimethanol), bisphenols (bisphenol A), and alkylene oxide (ethylene oxide or propylene oxide) adducts on alicyclic diols and bisphenols.

The alkyl moiety in the alkylene glycol and alkylene ether glycol may be linear or branched. Additional examples are glycerol, trimethylolethane, trimethylolpropane, and pentaerythritol. A single one of these may be used by itself or two or more may be used in combination.

As necessary, a monobasic acid such as acetic acid or benzoic acid and a monohydric alcohol such as cyclohexanol or benzyl alcohol may also be used for the purpose of adjusting the acid value or hydroxyl value.

There are no particular limitations on the method for producing the polyester resin, but, for example, a transesterification method or direct polycondensation method, each as such or in combination, may be used.

Production of the polyester resin is preferably carried out at a polymerization temperature from 180° C. to 230° C.; as necessary the interior of the reaction system may be placed under reduced pressure; and the reaction preferably is run while removing the water or alcohol produced by condensation. When the monomer is not soluble or compatible at the reaction temperature, dissolution may be induced by the addition of a high-boiling solvent as a solubilizing agent. The polycondensation reaction is then carried out while distilling out the solubilizing agent. When a monomer is present that is poorly compatible in the copolymerization reaction, preferably the poorly compatible monomer is preliminarily condensed with an acid or alcohol intended for polycondensation with this monomer, followed by polycondensation with the main component.

The following are examples of catalysts that can be used for polyester production: titanium catalysts such as titanium tetraethoxide, titanium tetrapropoxide, titanium tetraisopropoxide, and titanium tetrabutoxide, as well as tin catalysts such as dibutyltin dichloride, dibutyltin oxide, and diphenyltin oxide.

The polyurethane resin is considered in the following. The polyurethane resin is the reaction product of a diol with a substance that contains the diisocyanate group, and resins having various functionalities can be obtained by adjusting the diol and diisocyanate.

The diisocyanate component can be exemplified by the following: aromatic diisocyanates having from 6 to 20 carbon atoms (excluding the carbon in the NCO group, the same applies in the following), aliphatic diisocyanates having from 2 to 18 carbon atoms, and alicyclic diisocyanates having from 4 to 15 carbon atoms, as well as modifications of these diisocyanates (modifications that contain the urethane group, carbodiimide group, allophanate group, urea group, biuret group, uretdione group, uretoimine group, isocyanurate group, or oxazolidone group, also referred to herebelow as "modified diisocyanate") and mixtures of two or more of the preceding.

The following are examples of the aromatic diisocyanates: m- and/or p-xylylene diisocyanate (XDI) and α,α,α',α'-tetramethylxylylene diisocyanate.

The following are examples of the aliphatic diisocyanates: ethylene diisocyanate, tetramethylene diisocyanate, hexamethylene diisocyanate (HDI), and dodecamethylene diisocyanate.

The following are examples of the alicyclic diisocyanates: isophorone diisocyanate (IPDI), dicyclohexylmethane-4,4'-diisocyanate, cyclohexylene diisocyanate, and methylcyclohexylene diisocyanate.

Preferred among the preceding are aromatic diisocyanates having from 6 to 15 carbon atoms, aliphatic diisocyanates having from 4 to 12 carbon atoms, and alicyclic diisocyanates having from 4 to 15 carbon atoms, wherein XDI, IPDI, and HDI are particularly preferred.

A trifunctional or higher functional isocyanate compound may also be used in addition to the diisocyanate component.

The same dihydric alcohols usable for the polyester resin as described above can be adopted for the diol component that can be used for the polyurethane resin.

The melamine resin is the polycondensate of melamine and formaldehyde, and the monomer used to form the melamine resin is melamine. The urea resin is the polycondensate of urea and formaldehyde, and the monomer used to form the urea resin is urea. The melamine and urea may be subjected to known modifications.

Preferred ranges are described in the following for the use of a thermoplastic resin as the amorphous resin, but there is no limitation to this or by this.

The glass transition temperature (Tg) of the amorphous resin is preferably from 50° C. to 150° C. Within this range, the transferability can be increased without impairing the low-temperature fixability. From 60° C. to 130° C. is more preferred, and from 65° C. to 120° C. is still more preferred.

The weight-average molecular weight of the amorphous resin is preferably from 5,000 to 500,000. Within this range, the transferability can be increased without impairing the low-temperature fixability. From 6,000 to 200,000 is more preferred, and from 7,000 to 100,000 is still more preferred.

The content of the amorphous resin of the shell layer, per 100 mass parts of the binder resin, is preferably from 0.1 mass parts to 40.0 mass parts. From 0.2 mass parts to 30.0 mass parts is more preferred, and from 0.4 mass parts to 25.0 mass parts is still more preferred.

When the shell layer is constituted of two or more amorphous resins, $SP_{S1}$ and $SP_{S2}$ satisfy the following formula (2) when the resin having the highest SP value of the resins constituting the shell layer is designated as resin S1, the resin having the lowest SP value of the resins constituting the shell layer is designated as resin S2, the SP value of the resin S1 is denoted by $SP_{S1}$ $(J/cm^3)^{0.5}$, and the SP value of the resin S2 is denoted by $SP_{S2}$ $(J/cm^3)^{0.5}$.

$$SP_{S1}-SP_{S2}\leq 3.0 \quad (2)$$

In this case, the toner particle surface is rendered satisfactorily uniform and toner having an excellent transferability can be obtained. $SP_{S1}-SP_{S2}$ is preferably equal to or less than 2.0. The lower limit is not particularly limited, but is preferably equal to or greater than 0. The shell layer is more preferably constituted of one species of single amorphous resin.

The thickness of the shell layer is preferably 2 nm to 100 nm. When the shell layer thickness is in the indicated range, charge leakage can be effectively suppressed without impairing the low-temperature fixability. This thickness of the shell layer is more preferably 5 nm to 50 nm.

By having the polymer A in the present invention satisfy the contents for the first polymerizable monomer and the second polymerizable monomer in the aforementioned composition and satisfy formula (3), the polymer A is then readily provided with a block copolymer-like structure in which the crystalline segments and the amorphous segments are separated. The binder resin therefore readily assumes a structure in which the crystalline segments and amorphous segments have undergone microphase separation. A toner that has both an excellent low-temperature fixability and an excellent transferability can be obtained as a consequence.

Other materials used in the present invention are described in detail in the following.

<Binder Resin>

Known resins, e.g., vinyl resins, polyester resins, polyurethane resins, epoxy resins, and so forth, may also be used, in addition to the polymer A, for the binder resin in the toner particle.

The polyester resins and polyurethane resins described above in the section on amorphous resins may be used for the polyester resin and polyurethane resin here. In addition, the polymerizable monomer usable for the vinyl resin can be exemplified by the polymerizable monomers usable for the first polymerizable monomer, the second polymerizable monomer, and the third polymerizable monomer as described above. A combination of two or more may be used as necessary.

The content of the polymer A in the binder resin is preferably at least 50.0 mass %. Having this be at least 50.0 mass % facilitates retention of the sharp melt property by the toner and enhances the low-temperature fixability. From 80.0 mass % to 100 mass % is more preferred, while the binder resin still more preferably is the polymer A.

<Wax>

The toner particle may contain a wax.

The wax can be exemplified by the following: esters between a monohydric alcohol and a monocarboxylic acid, e.g., behenyl behenate, stearyl stearate, and palmityl palmitate; esters between a dibasic carboxylic acid and a monoalcohol, e.g., dibehenyl sebacate; esters between a dihydric alcohol and a monocarboxylic acid, e.g., ethylene glycol distearate and hexanediol dibehenate; esters between a trihydric alcohol and a monocarboxylic acid, e.g., glycerol tribehenate; esters between a tetrahydric alcohol and a monocarboxylic acid, e.g., pentaerythritol tetrastearate and pentaerythritol tetrapalmitate; esters between a hexahydric alcohol and a monocarboxylic acid, e.g., dipentaerythritol hexastearate and dipentaerythritol hexapalmitate; synthetic ester waxes such as esters between a polyfunctional alcohol and a monocarboxylic acid, e.g., polyglycerol behenate; natural ester waxes such as carnauba wax and rice wax; petroleum-based hydrocarbon waxes, e.g., paraffin wax, microcrystalline wax, and petrolatum, and derivatives thereof; hydrocarbon waxes provided by the Fischer-Tropsch process and derivatives thereof; polyolefin-type hydrocarbon waxes, e.g., polyethylene wax and polypropylene wax, and their derivatives; higher aliphatic alcohols; fatty acids such as stearic acid and palmitic acid; and acid amide waxes.

The wax content preferably satisfies the following formula (4) using W mass parts for the content of the wax and A mass parts for the content of the first monomer unit, for 100 mass parts for the content of the polymer A in the toner.

$$0.2\times A\leq W\leq A \quad (4)$$

The toner according to the present invention exhibits a high storability due to the polymer A having a high crystallinity and due to the coating with the shell. However, in environments where high and low temperatures occur repetitively, for example, storage in a locale where there is a large day-to-night temperature difference, the crystallinity may be degraded, as a consequence of which the phase separation between the crystalline segments and the amorphous segments becomes ill-defined and the resistance value of the polymer A may decline. In addition, the uniformity of the toner particle surface may decline because the crystalline segments compatibilize into the shell layer. The transferability post-storage may be reduced for these reasons.

When the wax amount W satisfies formula (4), the wax compatibilizes into a portion of the crystalline segments in the toner and a portion is present in a precipitated state in the crystalline segments. Because the precipitated wax acts as a nucleating agent for the crystalline segments, and because recrystallization of the crystalline segments is promoted accompanying crystallization of the compatibilized wax, a high crystallinity can then be maintained even after storage in an environment that exhibits large temperature differences. Reductions in the transferability post-storage can be suppressed as a result.

When wax is added in large amounts to a toner for which amorphous binder resin is the major component, due to the large difference in SP values between the wax and the binder resin, phase-separated wax may exude to the surface as a consequence of storage and/or use in a high-temperature environment. The non-electrostatic attachment force by the toner is increased under the influence of the exuded wax and the transferability may be reduced.

However, due, in the toner according to the present invention, to the occurrence of phase separation between the low-SP crystalline segments and the high-SP amorphous segments in the polymer A, the low-SP wax is trapped in the crystalline segments and as a result exudation of the wax to the toner particle surface can be suppressed. Reductions in the transferability are thus restrained even when the wax is added in large amounts.

The wax amount W more preferably satisfies the following formula (5).

$$0.2\times A\leq W\leq 0.8\times A \quad (5)$$

By having the wax amount W satisfy formula (5), wax exudation is more effectively suppressed and obtaining a toner having an even better transferability is then facilitated. In addition, the crystalline segments can more effectively plasticize the amorphous segments during fixing and the low-temperature fixability is then enhanced.

Further, W is more preferably from 10.0 to 40.0, because precipitation of wax to the toner surface can be inhibited.

Furthermore, hydrocarbon waxes or ester waxes can be preferably used, and hydrocarbon waxes can be more preferably used, because these waxes act as excellent nucleating agents.

<Polymerization Initiator>

Known polymerization initiators can be used without particular limitation as the polymerization initiator for obtaining polymer A.

The following are specific examples: peroxide-type polymerization initiators such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenylacetic acid-tert-hydroperoxide, tert-butyl performate, tert-butyl peracetate, tert-butyl perbenzoate, tert-butyl perphenylacetate, tert-butyl permethoxyacetate, per-N-(3-toluyl)palmitic acid-tert-butylbenzoyl peroxide, t-butyl peroxy-2-ethylhexanoate, t-butyl peroxypivalate, t-butyl peroxyisobutyrate, t-butyl peroxyneodecanoate, methyl ethyl ketone peroxide, diisopropyl peroxycarbonate, cumene hydroperoxide, 2,4-dichlorobenzoyl peroxide, and lauroyl peroxide; and azo and diazo polymerization initiators as represented by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

<Colorant>

The toner may contain a colorant.

The heretofore known magnetic bodies and pigments and dyes in the colors of black, yellow, magenta, and cyan as well as in other colors may be used without particular limitation as this colorant.

For example, black pigments as specifically represented by, e.g., carbon black, may be used as the black colorant.

The yellow colorant can be specifically exemplified by yellow pigments and yellow dyes as represented by, e.g., monoazo compounds, disazo compounds, condensed azo compounds, isoindolinone compounds, benzimidazolone compounds, anthraquinone compounds, azo metal complexes, methine compounds, and allylamide compounds. Examples at a more specific level are C. I. Pigment Yellow 74, 93, 95, 109, 111, 128, 155, 174, 180, and 185 and C. I. Solvent Yellow 162.

The magenta colorant can be specifically exemplified by magenta pigments and magenta dyes, e.g., monoazo compounds, condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples at a more specific level are C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269 and C. I. Pigment Violet 19.

The cyan colorant can be specifically exemplified by cyan pigments and cyan dyes, e.g., copper phthalocyanine compounds and derivatives thereof, anthraquinone compounds, and basic dye lake compounds. Examples at a more specific level are C. I. Pigment Blue 1, 7, 15, 15:1, 15:2, 15:3, 15:4, 60, 62, and 66.

The content of the colorant is preferably from 1.0 mass parts to 20.0 mass parts per 100.0 mass parts of the binder resin.

The toner may also be made into a magnetic toner through the incorporation of a magnetic body. In this case, the magnetic body may also function as a colorant.

The magnetic body can be exemplified by iron oxides as represented by magnetite, hematite, and ferrite; metals as represented by iron, cobalt, and nickel; alloys of these metals with a metal such as aluminum, cobalt, copper, lead, magnesium, tin, zinc, antimony, beryllium, bismuth, cadmium, calcium, manganese, selenium, titanium, tungsten, and vanadium; and mixtures thereof.

When a magnetic body is used, its content is preferably 40.0 mass parts to 150.0 mass parts per 100.0 mass parts of the binder resin.

<Charge Control Agent>

The toner may contain a charge control agent.

The heretofore known charge control agents may be used without particular limitation as this charge control agent. Negative-charging charge control agents can be specifically exemplified by metal compounds of aromatic carboxylic acids such as salicylic acid, alkylsalicylic acid, dialkylsalicylic acid, naphthoic acid, and dicarboxylic acids, and by polymers and copolymers bearing such a metal compound of an aromatic carboxylic acid; polymers and copolymers bearing a sulfonic acid group, sulfonate salt group, or sulfonate ester group; metal salts and metal complexes of azo dyes and azo pigments; and boron compounds, silicon compounds, and calixarene.

The positive-charging charge control agents can be exemplified by quaternary ammonium salts and polymeric compounds that have a quaternary ammonium salt in side chain position; guanidine compounds; nigrosine compounds; and imidazole compounds.

The polymers and copolymers bearing a sulfonate salt group or sulfonate ester group can be exemplified by homopolymers of a sulfonic acid group-containing vinyl monomer such as styrenesulfonic acid, 2-acrylamido-2-methylpropanesulfonic acid, 2-methacrylamido-2-methylpropanesulfonic acid, vinylsulfonic acid, and methacrylsulfonic acid, and by copolymers of these sulfonic acid group-containing vinyl monomers with vinyl monomer as indicated in the section on the binder resin.

The content of the charge control agent is preferably from 0.01 mass parts to 5.0 mass parts per 100.0 mass parts of the binder resin.

<External Additive>

The toner may contain an external additive.

The heretofore known external additives may be used without particular limitation as this external additive. Specific examples are as follows: base silica fine particles, e.g., silica produced by a wet method or silica produced by a dry method; silica fine particles provided by subjecting such base silica fine particles to a surface treatment with a treatment agent such as a silane coupling agent, titanium coupling agent, silicone oil, and so forth; and resin fine particles such as vinylidene fluoride fine particles, polytetrafluoroethylene fine particles, and so forth.

The content when the external additive is incorporated is preferably from 0.1 mass parts to 5.0 mass parts per 100.0 mass parts of the toner particle.

Methods for producing the toner are described in detail in the following.

A heretofore known method, e.g., a suspension polymerization method, dissolution suspension method, emulsion aggregation method, or pulverization method, can be used as the method for producing the toner; however, the toner production method is not limited to these. These methods can be broadly classified into suspension polymerization, in which the toner is produced at the same time as polymer production, and dissolution suspension, emulsion aggregation, and pulverization, in which the toner is produced using a separately produced polymer.

Methods for obtaining the toner by suspension polymerization and by emulsion aggregation are described in the following as examples.

<Method of Toner Production by Suspension Polymerization>

(Dispersion Step)

A starting material dispersion is prepared by combining any optional materials with a polymerizable monomer composition comprising the first polymerizable monomer of at least one (meth)acrylate ester having an alkyl group having 18 to 36 carbon atoms, one or more second polymerizable monomers, and optionally a third polymerizable monomer, and subjecting these to melting, dissolution, or dispersion using a disperser. The highly hydrophilic amorphous resin, which forms the shell by migration to the toner particle surface layer during polymerization, should be added to the starting material dispersion at this point in an appropriate amount in conformity to the thickness of the desired shell layer.

The colorant, wax, and charge control agent described in the sections on the materials, solvent in order to adjust the viscosity, and other additives may optionally be added as appropriate. The solvent for viscosity adjustment should be solvent that has a low solubility in water and that can thoroughly dissolve/disperse the aforementioned materials, but is not otherwise particularly limited and known solvents can be used. Examples are toluene, xylene, and ethyl acetate. The disperser can be exemplified by homogenizers, ball mills, colloid mills, and ultrasound dispersers.

(Granulation Step)

The starting material dispersion is introduced into a preliminarily prepared aqueous medium and a suspension is prepared using a disperser such as a high-speed stirrer or an ultrasound disperser. The aqueous medium preferably contains a dispersion stabilizer in order to adjust the particle diameter and inhibit aggregation. The dispersion stabilizer is not particularly limited and heretofore known dispersion stabilizers can be used.

The following are examples of inorganic dispersion stabilizers: phosphate salts as represented by tribasic calcium phosphate, dibasic calcium phosphate, magnesium phosphate, aluminum phosphate, and zinc phosphate; carbonates as represented by calcium carbonate and magnesium carbonate; metal hydroxides as represented by calcium hydroxide, magnesium hydroxide, and aluminum hydroxide; sulfate salts as represented by calcium sulfate and barium sulfate; as well as calcium metasilicate, bentonite, silica, and alumina.

The following are examples of organic dispersion stabilizers: polyvinyl alcohol, gelatin, methyl cellulose, methyl hydroxypropyl cellulose, ethyl cellulose, the sodium salt of carboxymethyl cellulose, polyacrylic and salts thereof, and starch.

Due to their high charge polarization and strong adsorptive strength for oil phases, inorganic charge stabilizers exhibit a strong aggregation-inhibiting action and are thus preferred. In addition, hydroxyapatite, tribasic calcium phosphate, and dibasic calcium phosphate are more preferred because they can be easily removed by adjusting the pH.

(Polymerization Step)

A toner particle containing polymer A is obtained by polymerizing the polymerizable monomer in the suspension.

The polymerization initiator may be admixed together with the other additives during preparation of the starting material dispersion or may be mixed into the starting material dispersion immediately before suspension in the aqueous medium. In addition, as necessary it may also be added, dissolved in polymerizable monomer or another solvent, during the granulation step or after completion of the granulation step, i.e., immediately before the initiation of the polymerization step. After the polymer has been obtained by the polymerization of the polymerizable monomer, an aqueous dispersion of toner particles is obtained as necessary by carrying out a solvent removal process by the application of heat or reduced pressure.

When a highly hydrophilic amorphous resin has been added to the starting material dispersion, the amorphous resin migrates to the toner particle surface layer from the granulation step through the polymerization step to form the shell layer.

(Filtration Step, Washing Step, Drying Step, Classification Step, External Addition Step)

A toner particle is obtained by the execution of a filtration step in which a solid fraction is obtained by solid-liquid separation from the aqueous toner particle dispersion, an optional washing step, a drying step, and a classification step in order to adjust the granulometry. This toner particle may be used as such as toner. A toner may also be obtained as necessary by attaching an external additive, e.g., an inorganic fine powder, to the toner particle by mixing the external additive and the toner particle using a mixer.

<Method of Toner Production by Emulsion Aggregation>

(Polymer A Production Step)

A heretofore known production method, e.g., solution polymerization, suspension polymerization, emulsion polymerization, bulk polymerization, dispersion polymerization, and so forth, may be used as the method for producing the polymer A, but there is no limitation to these.

A method for obtaining the polymer A by solution polymerization is described as an example in the following.

A monomer solution is prepared by dissolving, in a solvent such as toluene, a polymerizable monomer composition comprising the first polymerizable monomer of at least one (meth)acrylate ester having an alkyl group having 18 to 36 carbon atoms, one or more second polymerizable monomers, and optionally a third polymerizable monomer. The polymerization initiator is added to this, and a polymer solution of the polymer A dissolved in the solvent, e.g., toluene, is then obtained by polymerizing the polymerizable monomer. The polymer A is precipitated by mixing the polymer solution with a solvent (e.g., methanol) in which the polymer A is insoluble. The precipitated polymer A is filtered and washed to obtain the polymer A.

(Resin Fine Particle Dispersion Preparation Step)

The dispersion of resin fine particles can be prepared by known methods, but there is no limitation on these methods. Examples are emulsion polymerization; self-emulsification; phase inversion emulsification, in which the resin is emulsified by the addition of an aqueous medium to a solution of the resin dissolved in an organic solvent; and forced emulsification, in which the resin is forcibly emulsified, without the use of an organic solvent, by carrying out a high-temperature treatment in an aqueous medium.

A method of preparing the resin fine particle dispersion using phase inversion emulsification is described in the following as an example.

The polymer A-containing resin component is dissolved in an organic solvent in which the resin component dissolves and a surfactant and/or a basic compound is added. If the resin component is a crystalline resin having a melting point, dissolution should be carried out by heating to or above the melting point. Then, while performing stirring with, e.g., a homogenizer, an aqueous medium is gradually added to precipitate resin fine particles. This is followed by removal of the solvent by the application of heat or reduced pressure to produce an aqueous dispersion of resin fine particles.

The organic solvent used to dissolve the polymer A-containing resin component should be able to dissolve the polymer A-containing resin component. Specific examples are toluene and xylene.

There are no particular limitations on the surfactant used in the preparation step, and the following are examples: anionic surfactants such as the salts of sulfate esters, sulfonate salts, carboxylate salts, phosphate esters, and soaps; cationic surfactants such as amine salts and quaternary ammonium salts; and nonionic surfactants such as polyethylene glycols, ethylene oxide adducts on alkylphenols, and polyhydric alcohol systems. A single surfactant may be used by itself or two or more may be used in combination.

The basic compound used in the preparation step can be exemplified by inorganic bases such as sodium hydroxide and potassium hydroxide and by ammonia and organic bases such as triethylamine, trimethylamine, dimethylaminoethanol, and diethylaminoethanol. A single basic compound may be used by itself or two or more may be used in combination.

(Preparation of Colorant Dispersion)

Known dispersion methods can be used to prepare the colorant dispersion, and, for example, a common dispersion means can be used without any limitation whatsoever, e.g., a homogenizer, ball mill, colloid mill, ultrasound disperser, and so forth. The surfactants indicated above are examples of surfactants that can be used for this dispersion.

(Preparation of Wax Dispersion)

The wax dispersion is prepared by dispersing a wax in water in combination with, e.g., a surfactant and/or a basic compound, followed by heating to a temperature equal to or greater than the melting point of the wax while carrying out a dispersion process using a disperser or homogenizer that applies a strong shear force. The execution of this process yields a wax dispersion. The surfactant used for dispersion here can be exemplified by the surfactants already described above. The basic compound used for dispersion here can also be exemplified by the basic compounds already described above.

(Aggregated Particle Formation Step)

In the aggregated particle formation step, a mixture is first made by mixing the resin fine particle dispersion, the colorant dispersion, the wax dispersion, and so forth. Aggregation is then induced by bringing the pH into the acidic region while heating at a temperature below the melting point of the resin fine particles, thus obtaining an aggregated particle dispersion through the formation of aggregated particles that contain resin fine particles, colorant particles, and release agent particles.

(First Fusion Step)

In the first fusion step, while operating under stirring conditions that conform to the aggregated particle formation step, the development of aggregation is halted by raising the pH of the aggregated particle dispersion, and a fused particle dispersion is obtained by heating to a temperature equal to or greater than the melting point of the previously described polymer.

(Step of Amorphous Resin Fine Particle Attachment)

In the step of amorphous resin fine particle attachment, a dispersion of resin-attached particles is obtained by adding an amorphous resin particle dispersion to the fused particle dispersion and inducing attachment of the amorphous resin fine particles to the surface of the fused particles by dropping the pH. Here, this coating layer corresponds to the shell layer that is formed by the execution of the shell layer formation steps that are described below. The amorphous resin fine particle dispersion can be produced in accordance with the previously described resin fine particle dispersion preparation step.

(Second Fusion Step)

In the second fusion step, in accordance with the first fusion step the development of aggregation is halted by raising the pH of the resin-attached particle dispersion, and a shell layer-bearing toner particle is obtained by inducing fusion of the resin-attached aggregated particle by heating to a temperature equal to or greater than the melting point of the polymer A.

(Filtration Step, Washing Step, Drying Step, Classification Step, External Addition Step)

A toner particle is obtained by the subsequent execution of a filtration step in which a toner particle solid fraction is separated off by filtration and the execution of an optional washing step, a drying step, and a classification step in order to adjust the granulometry. This toner particle may be used as such as toner. A toner may also be obtained as necessary by attaching an external additive, e.g., an inorganic fine powder, to the toner particle by mixing the external additive and the toner particle using a mixer.

<Other Methods for Forming Shell Layer>

Formation of the shell layer at the same time as toner particle production as described above can be used with the suspension polymerization method and emulsion aggregation method. Shell layer formation by the same method as for the suspension polymerization method is also possible with the dissolution suspension method.

In other methods, the shell layer can be formed after the toner core has been formed. Examples are described in the following of a method in which shell layer formation is carried out by emulsion aggregation on an aqueous dispersion of the toner core (the toner core dispersion in the following) and a method in which shell layer formation is carried out on the toner core dispersion using a thermosetting resin precursor; however, there is no limitation to these.

<Shell Layer Formation by Emulsion Aggregation>

The shell layer can be formed by executing, on the toner core dispersion, the same procedures as in the step of amorphous resin fine particle attachment and the second fusion step in the above-described method of toner production by emulsion aggregation.

A toner particle is then obtained by the execution of a filtration step in which a toner particle solid fraction is separated off by filtration and the execution of an optional washing step, a drying step, and a classification step in order to adjust the granulometry.

<Shell Layer Formation Using Thermosetting Resin Precursor>

The pH of the toner core dispersion is adjusted to around 4, followed by the dissolution of shell layer-forming material in the toner core-containing aqueous dispersion. The shell layer-forming material in the dispersion is subsequently reacted to form a shell layer coating the toner core surface and thereby provide a toner particle dispersion.

Here, the shell layer may be formed, for example, by the reaction of melamine, urea, and a glyoxal/urea reaction product and a precursor (methylolate) produced by their addition reaction with formaldehyde.

A toner particle is then obtained by the execution of a filtration step in which a toner particle solid fraction is separated off by filtration and the execution of an optional washing step, a drying step, and a classification step in order to adjust the granulometry.

The methods used to measure the toner according to the present invention are described in the following.

<Method for Calculating Percentage Over which Shell Layer is Observed and Thickness of Shell Layer>

The percentage over which the shell layer is observed (coverage ratio) and the thickness of the shell layer can be determined for the toner by measuring the geometry of the single toner particle cross section. The specific method for measuring the geometry of the single toner particle cross section is as follows.

First, the toner is thoroughly dispersed in a photocurable epoxy resin and the epoxy resin is then cured by exposure to ultraviolet radiation. The resulting cured product is sectioned using a microtome equipped with a diamond blade to prepare 100 nm-thick thin-section samples. The samples are stained using ruthenium tetroxide, followed by observation of the toner cross sections using a transmission electron microscope (TEM) (product name: Tecnai TF20XT Electron Microscope, FEI Company) at an acceleration voltage of 120 kV to acquire TEM images. Toner particle cross sections selected for observation at this time are those having a long axis diameter that is 0.9-times to 1.1-times the number-average particle diameter (D1) measured on the same toner using the method described below for measuring the number-average particle diameter (D1) of the toner particle.

In this particular observation method, the amorphous resin in the toner particle is strongly stained by the ruthenium tetroxide. As a result, the shell region, where amorphous resin is the major component, undergoes staining, while the core region, where the major component is non-staining crystalline resin, can be observed through contrast. The observation amplification is 20,000×.

Based on the resulting TEM image, the length C1 (nm) is determined in a single toner particle cross section of the region over which the shell layer is observed in the circumferential length of the single toner particle; the length C2 (nm) is determined for the single toner particle cross section of the single toner particle circumference; and C1/C2×100 (%) is taken to be the coverage ratio for the shell layer (percentage when the shell layer is observed).

In addition, the long axis of the single toner particle is taken to be longest line segment that passes through the geometric center of the single toner particle cross section, and its length is taken to be the long axis diameter R (nm). The shell layer thickness is taken to be (R−r)/2 (nm) when r (nm) is the length between the two core/shell interfaces on the long axis.

Measurement of the percentage over which the shell layer is observed and the shell layer thickness is performed on 100 toner particles and the resulting arithmetic average values are used.

<Method for Measuring Contents of Monomer Units Derived from Various Polymerizable Monomers in Polymer A>

The contents of the monomer units derived from the various polymerizable monomers in the polymer A are measured by $^1$H-NMR using the following conditions.

measurement instrument: JNM-EX400 FT-NMR instrument (JEOL Ltd.)
measurement frequency: 400 MHz
pulse condition: 5.0 μs
frequency range: 10,500 Hz
number of accumulations: 64
measurement temperature: 30° C.
sample: This is prepared by introducing 50 mg of the measurement sample into a sample tube with an inner diameter of 5 mm; adding deuterochloroform ($CDCl_3$) as the solvent; and dissolving in a thermostat at 40° C.

From among the peaks assigned to the constituent components of the monomer unit derived from the first polymerizable monomer in the resulting $^1$H-NMR chart, a peak is selected that is independent from the peaks assigned to the constituent components from otherwise derived monomer units, and the integration value S1 of this peak is calculated. Similarly, from among the peaks assigned to the constituent components of the monomer unit derived from the second polymerizable monomer, a peak is selected that is independent from the peaks assigned to the constituent components from otherwise derived monomer units, and the integration value S2 of this peak is calculated.

When a third polymerizable monomer has been used, from among the peaks assigned to the constituent components of the monomer unit derived from the third polymerizable monomer, a peak is selected that is independent from the peaks assigned to the constituent components from otherwise derived monomer units, and the integration value S3 of this peak is calculated.

The content of monomer unit derived from the first polymerizable monomer is determined as follows using the integration values S1, S2, and S3. n1, n2, and n3 are the number of hydrogens in the constituent component to which the peak of interest for the particular segment is assigned.

$$\text{content (mol \%) of monomer unit derived from the first polymerizable monomer}=\{(S1/n1)/((S1/n1)+(S2/n2)+(S3/n3))\}\times 100$$

The content of the monomer unit derived from the second polymerizable monomer and the content of the monomer unit derived from the third polymerizable monomer unit are similarly determined as follows.

$$\text{content (mol \%) of monomer unit derived from the second polymerizable monomer}=\{(S2/n2)/((S1/n1)+(S2/n2)+(S3/n3))\}\times 100$$

$$\text{content (mol \%) of monomer unit derived from the third polymerizable monomer}=\{(S3/n3)/((S1/n1)+(S2/n2)+(S3/n3))\}\times 100$$

When polymerizable monomer that does not contain the hydrogen atom in a constituent component other than the vinyl group is used for the polymer A, $^{13}$C is used for the measurement atomic nucleus using $^{13}$C-NMR; measurement is performed in single pulse mode; and the calculation is carried out proceeding as with the $^1$H-NMR.

In addition, when the toner is produced by suspension polymerization, the peaks for the release agent and other resins may overlap and an independent peak may not be observed. Due to this, it may then not be possible in some instances to calculate the contents of the monomer units derived from the various polymerizable monomers in the polymer A. When this is the case, a polymer A' is produced by the same suspension polymerization, but without using the release agent and other resins, and the analysis can then be performed taking the polymer A' as the polymer A.

<Method for Calculating SP Values>

$SP_{12}$ and $SP_{22}$ are determined as follows in accordance with the method of calculation proposed by Fedors.

For each of the polymerizable monomers, the energy of vaporization (Δei) (cal/mol) and the molar volume (Δvi) ($cm^3$/mol) are determined from the tables given in "Polym. Eng. Sci., 14(2), 147-154 (1974)" for the atoms or atomic groups in the molecular structure, and $(4.184\times\Sigma\Delta ei/\Sigma\Delta vi)^{0.5}$ is used for the SP value $(J/cm^3)^{0.5}$.

$SP_{11}$ and $SP_{21}$ are determined by this same calculation method on the atoms or atomic groups in the molecular structure residing in the state provided by cleavage of the double bond in the polymerizable monomer due to polymerization.

$SP_{S1}$ and $SP_{S2}$ are determined are follows.

The SP value ($SP_S$) of the resin constituting the shell layer is determined as follows and is calculated using the formula (S1) below: the energy of vaporization (Δei) and the molar volume (Δvi) of the repeat units constituting this resin are determined for each repeat unit; the product with the molar ratio (j) of the particular repeat unit in the resin is calculated for each; and the total of the energies of vaporization for each repeat unit is divided by the total of the molar volumes.

$$SP_S=\{(\Sigma j\times\Sigma\Delta ei)/(\Sigma j\times\Sigma\Delta vi)\}^{1/2} \quad \text{formula (S1)}$$

$SP_S$ is calculated in this manner for each resin constituting the shell layer. The largest value in this set is designated as $SP_{S1}$, and the smallest value is designated as $SP_{S2}$.

The unit for the SP value in the present invention is $(J/m^3)^{0.5}$, but this can be converted to the $(cal/cm^3)^{0.5}$ unit using 1 $(cal/cm^3)^{0.5}=2.045\times10^3$ $(J/m^3)^{0.5}$.

<Method for Measuring Weight-Average Molecular Weight Mw of Polymer A>

The weight-average molecular weight (Mw) of the THF-soluble matter in the polymer A is measured using gel permeation chromatography (GPC) as follows.

First, the sample is dissolved in tetrahydrofuran (THF) at room temperature for 24 hours. The obtained solution is filtered using a "Sample Pretreatment Cartridge" (Tosoh Corporation) solvent-resistant membrane filter having a pore diameter of 0.2 μm to obtain a sample solution. The sample solution is adjusted to a THF-soluble component concentration of 0.8 mass %. Measurement is carried out under the following conditions using this sample solution.

instrument: HLC8120 GPC (detector: RI) (Tosoh Corporation)
column: 7-column train of Shodex KF-801, 802, 803, 804, 805, 806, and 807
(Showa Denko Kabushiki Kaisha)
eluent: tetrahydrofuran (THF)
flow rate: 1.0 mL/min
oven temperature: 40.0° C.
sample injection amount: 0.10 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Method for Measuring Endothermic Quantity of Endothermic Peak of Toners>

The endothermic quantity of the endothermic peak associated with the melting of the polymer A in the toner is measured using the following conditions and a DSC Q1000 (TA Instruments).

ramp rate: 10° C./min measurement start temperature: 20° C.

measurement end temperature: 180° C.

The melting points of indium and zinc are used for temperature correction in the instrument detection section, and the heat of fusion of indium is used for correction of the amount of heat.

Specifically, 5 mg of the toner is exactly weighed out and introduced into an aluminum pan and differential scanning calorimetric measurement is carried out. An empty silver pan is used for reference.

The endothermic quantity of the endothermic peak associated with the melting of the polymer A in the first temperature ramp process is taken to be the endothermic quantity of the endothermic peak of the toner. When, for a toner containing the polymer A and wax, the endothermic peak associated with the melting of the polymer A overlaps the endothermic peak associated with the melting of the wax, the measurement described above is performed separately on the wax in order to determine the endothermic quantity for the endothermic peak associated with the melting of the wax. The endothermic quantity of the endothermic peak associated with the melting of the polymer A is taken to be the value provided by subtracting the endothermic quantity for the endothermic peak associated with the melting of the wax, from the endothermic quantity for the endothermic peaks observed to overlap.

<Method for Measuring Melting Point of Polymer A and Wax>

The melting point of the polymer A and the melting point of the wax are measured in this invention using the following conditions and a DSC Q1000 (TA Instruments).

ramp rate: 10° C./min measurement start temperature: 20° C.

measurement end temperature: 180° C.

The melting points of indium and zinc are used for temperature correction in the instrument detection section, and the heat of fusion of indium is used for correction of the amount of heat.

Specifically, 5 mg of the sample is exactly weighed out and introduced into an aluminum pan and differential scanning calorimetric measurement is carried out. An empty silver pan is used for reference.

The melting point is taken to be the peak temperature in the maximum endothermic peak during the first temperature ramp process.

When a plurality of peaks are present, the maximum endothermic peak is taken to be the peak having the largest endothermic quantity.

<Method for Measuring Charge Decay Rate Coefficient of Polymer A>

The charge decay rate coefficient of the polymer A is measured using an NS-D100 electrostatic diffusivity analyzer (Nano Seeds Corporation).

First, approximately 100 mg of the polymer A is filled into the sample pan and this is scraped in order to provide a smooth, flat surface. The sample pan is exposed for 30 seconds to x-rays from an x-ray charge remover in order to extinguish the charge on the polymer A. The discharged sample pan is mounted on the measurement plate. A metal plate is mounted at the same time as a Reference for zero correction of the surface potentiometer. The sample-bearing measurement plate is held prior to measurement for at least one hour in a 30° C./80% RH environment.

The measurement conditions are set as follows.

charging time: 0.1 s measurement time: 1800 s measurement interval: 1 s discharge polarity: − electrode: present

The initial potential is set to −600 V and the change in the surface potential is measured beginning immediately after charging. The charge decay rate coefficient α is determined by fitting the obtained results to the following formula. Obtained charge decay rate coefficient α is taken to be the charge decay constant.

$$V_t = V_0 \exp(-\alpha t^{1/2})$$

$V_t$: surface potential (V) at time t $V_0$: starting surface potential (V)

t: time after charging (s)

α: charge decay rate coefficient

<Method for Measuring Acid Value of Polymer A>

The acid value is the mass (mg) of potassium hydroxide required to neutralize the acid contained in 1 g of a sample. The acid value of the polymer A is measured in the present invention in conformity with JIS K 0070-1992, and specifically is measured in accordance with the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed using the potassium hydroxide solution. The 0.1 mol/L hydrochloric acid used is prepared in accordance with JIS K 8001-1998.

(2) Procedure (A) Main Test

A 2.0 g sample of pulverized polymer A is exactly weighed into a 200-mL Erlenmeyer flask and 100 mL of a toluene/ethanol (2:1) mixed solution is added and dissolution is carried out over 5 hours. Several drops of the phenolphthalein solution are added as indicator and titration is performed using the potassium hydroxide solution. The titration endpoint is taken to be the persistence of the faint pink color of the indicator for 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A = [(C-B) \times f \times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

<Measurement of Weight-Average Particle Diameter (D4) and Number-Average Particle Diameter (D1) of Toner>

The weight-average particle diameter (D4) and the number-average particle diameter (D1) of the toner are determined proceeding as follows. The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of 1.0% and, for example, "ISOTON II" (Beckman Coulter, Inc.) can be used.

The dedicated software is configured as follows prior to measurement and analysis.

In the "modify the standard operating method (SOMME)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1,600 μA; the gain is set to 2; the electrolyte solution is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) 200.0 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) 30.0 mL of the aqueous electrolyte solution is introduced into a 100-mL flatbottom glass beaker. To this is added as dispersing agent 0.3 mL of a dilution prepared by the three-fold (mass) dilution with deionized water of "Contaminon N" (a 10% aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetra 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of the ultrasound disperser and 2.0 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of the toner particle is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the aqueous electrolyte solution prepared in (5) and containing dispersed toner particles, is dripped into the roundbottom beaker set in the sample stand as described in (1) with adjustment to provide a measurement concentration of 5%. Measurement is then performed until the number of measured particles reaches 50,000.

(7) The measurement data is analyzed by the dedicated software provided with the instrument and the weight-average particle diameter (D4) and the number-average particle diameter (D1) are calculated. When set to graph/volume % with the dedicated software, the "average diameter" on the "analysis/volumetric statistical value (arithmetic average)" screen is the weight-average particle diameter (D4). When set to graph/number % with the dedicated software, the "average diameter" on the "analysis/numerical statistical value (arithmetic average)" screen is the number-average particle diameter (D1).

EXAMPLES

The present invention is more specifically described in the examples provided below. However, these in no way limit the present invention. Unless specifically indicated otherwise, the "parts" and "%" in the examples and comparative examples are on a mass basis in all instances.

<Polymerizable Monomer Production Examples>

<Urethane Group-Containing Monomer>

50.0 parts of methanol was introduced into a reactor. This was followed by the dropwise addition of 5.0 parts of Karenz MOI [2-isocyanatoethyl methacrylate] (Showa Denko K. K.) at 40° C. while stirring. After the completion of the dropwise addition, stirring was carried out for 2 hours while maintaining 40° C. The unreacted methanol was then removed using an evaporator to yield a urethane group-containing monomer.

<Urea Group-Containing Monomer>

50.0 parts of dibutylamine was introduced into a reactor. This was followed by the dropwise addition of 5.0 parts of Karenz MOI [2-isocyanatoethyl methacrylate] at room temperature while stirring. Stirring was carried out for 2 hours after the completion of the dropwise addition. The unreacted dibutylamine was then removed using an evaporator to yield a urea group-containing monomer.

<Amorphous Resin Production Examples>

<Amorphous Resin 1>

The following materials were introduced into an autoclave equipped with a pressure-reduction apparatus, a water separation apparatus, a nitrogen gas introduction apparatus, a temperature measurement apparatus, and a stirrer.

| | |
|---|---|
| terephthalic acid | 32.3 parts (50.0 mol %) |
| 2 mol propylene oxide adduct on bisphenol A | 67.7 parts (50.0 mol %) |
| potassium titanium oxalate (catalyst) | 0.02 parts |

A reaction was then run at 220° C. under a nitrogen atmosphere and at normal pressure until the desired molecular weight was reached. Cooling and then pulverization provided an amorphous resin 1. The properties of amorphous resin 1 are given in Table 1.

<Amorphous Resin 2>

The following materials were introduced into an autoclave equipped with a pressure-reduction apparatus, a water separation apparatus, a nitrogen gas introduction apparatus, a temperature measurement apparatus, and a stirrer.

| | |
|---|---|
| terephthalic acid | 29.1 parts (45.0 mol %) |
| isophthalic acid | 3.2 parts (5.0 mol %) |
| 2 mol propylene oxide adduct on bisphenol A | 67.7 parts (50.0 mol %) |
| potassium titanium oxalate (catalyst) | 0.02 parts |

A reaction was then run at 220° C. under a nitrogen atmosphere and at normal pressure until the desired molecular weight was reached. Cooling and then pulverization provided an amorphous resin 2. The properties of amorphous resin 2 are given in Table 1.

<Amorphous Resin 3>

The following materials were introduced under a nitrogen atmosphere into a reactor fitted with a reflux condenser, stirrer, thermometer, and nitrogen introduction line.

| | |
|---|---|
| solvent: toluene | 100.0 parts |
| styrene | 91.7 parts |
| methyl methacrylate | 2.5 parts |
| methacrylic acid | 3.3 parts |

-continued

| | |
|---|---|
| 2-hydroxyethyl methacrylate | 2.5 parts |
| polymerization initiator: t-butyl peroxypivalate (PERBUTYL PV, NOF Corporation) | 5.0 parts |

While stirring in the aforementioned reactor at 200 rpm, a polymerization reaction was run for 12 hours with heating to 70° C. to obtain a solution in which a polymer of the monomer composition was dissolved in toluene. This solution was then cooled to 25° C. followed by the introduction of the solution while stirring into 1000.0 parts of methanol to precipitate methanol-insoluble matter. The resulting methanol-insoluble matter was filtered off and was additionally washed with methanol, followed by vacuum drying for 24 hours at 40° C. to yield an amorphous resin 3. The property values for amorphous resin 3 are given in Table 1.

<Amorphous Resins 4 to 6>

Amorphous resins 4 to 6 were obtained proceeding as in the production example for amorphous resin 3, but changing the amounts of polymerizable monomer introduction as indicated in Table 1. The properties of amorphous resins 4 to 6 are given in Table 1.

<Crystalline Resin 1>

The following materials were introduced into an autoclave equipped with a pressure-reduction apparatus, a water separation apparatus, a nitrogen gas introduction apparatus, a temperature measurement apparatus, and a stirrer.

| | |
|---|---|
| sebacic acid | 64.2 parts (50.0 mol %) |
| 1,6-hexanediol | 35.8 parts (50.0 mol %) |
| potassium titanium oxalate (catalyst) | 0.06 parts |

A reaction was then run at 220° C. under a nitrogen atmosphere and at normal pressure until the desired molecular weight was reached. Cooling and then pulverization provided a crystalline resin 1. The properties of crystalline resin 1 are given in Table 1.

TABLE 1

| | | Amorphous resin 1 | Amorphous resin 2 | Amorphous resin 3 | Amorphous resin 4 | Amorphous resin 5 | Amorphous resin 6 | Crystalline resin 1 |
|---|---|---|---|---|---|---|---|---|
| Type of resin | | Polyester | Polyester | Vinyl | Vinyl | Vinyl | Vinyl | Polyester |
| Structure | | Alternating | Random | Random | Homopolymer | Random | Homopolymer | Aternating |
| PES | Terephthalic acid | 32.3 | 29.1 | — | — | — | — | 0.0 |
| monomer | Isophthalic acid | 0.0 | 3.2 | — | — | — | — | 0.0 |
| introduction | BPA-PO | 67.7 | 67.7 | — | — | — | — | 0.0 |
| (parts) | 2 mol adduct | | | | | | | |
| | Sebacic acid | 0.0 | 0.0 | — | — | — | — | 64.2 |
| | 1,6-hexanediol | 0.0 | 0.0 | — | — | — | — | 35.8 |
| Vinyl | Styrene | — | — | 91.7 | 100.0 | 50.0 | 0.0 | — |
| monomer | Methyl methacrylate | — | — | 2.5 | 0.0 | 0.0 | 0.0 | — |
| introduction | Methacrylic acid | — | — | 3.3 | 0.0 | 0.0 | 0.0 | — |
| (parts) | 2-HEMA | — | — | 2.5 | 0.0 | 50.0 | 0.0 | — |
| | Methacrylonitrile | — | — | 0.0 | 0.0 | 0.0 | 100.0 | — |
| Properties | SP value $(J/cm^3)^{0.5}$ | 22.3 | 22.3 | 20.3 | 20.1 | 21.5 | 26.0 | 20.1 |
| | Weight-average molecular weight | 15200 | 15400 | 13500 | 14200 | 14600 | 13800 | 18900 |
| | Glass transition temperature (° C.) | 70 | 67 | 93 | 100 | 93 | 128 | — |
| | Melting point(° C.) | — | — | — | — | — | — | 70 |
| | Acid value (mg KOH/g) | 5.1 | 5.3 | 21.3 | 0.0 | 0.0 | 0.0 | 7.2 |

(*In Table 1, PES represents polyester; BPA-PO2 represents the 2 mol adduct of propylene oxide on bisphenol A; and 2-HEMA represents 2-hydroxyethyl methacrylate.)

<Production Examples for Amorphous Resin Fine Particle Dispersions>

<Amorphous Resin Fine Particle Dispersion 1>

The following materials were weighed into a reactor equipped with a thermometer.

| | |
|---|---|
| deionized water | 350.0 parts |
| sodium dodecylbenzenesulfonate | 5.0 parts |
| sodium laurate | 10.0 parts |

An aqueous dispersion S1 was obtained by heating to 90° C. while stirring the reactor at 7,000 rpm using a T. K. Robomix high-speed stirrer (PRIMIX Corporation). 100.0 parts of the amorphous resin 1 was separately dissolved in 100.0 parts of toluene at 90° C. The resulting toluene solution of the amorphous resin 1 was introduced, with stirring under the condition indicated above, into the aqueous dispersion S1, and stirring was performed under the condition indicated above. Emulsification at a pressure of 200 MPa was also performed using a Nanomizer high-pressure impact-type disperser (Yoshida Kikai Co., Ltd.).

After removal of the toluene using an evaporator, the concentration was adjusted to 20 mass % using deionized water to yield an amorphous resin fine particle dispersion 1 in which fine particles of the amorphous resin 1 were dispersed.

The 50% particle diameter (Dv50) on a volume basis of the amorphous resin fine particles 1 was measured at 0.12 μm using a Nanotrac UPA-EX150 dynamic light-scattering particle size distribution analyzer (Nikkiso Co., Ltd.).

<Amorphous Resin Fine Particle Dispersions 2 to 6>

Amorphous resin fine particle dispersions 2 to 6 were obtained proceeding as in the production example for amorphous resin fine particle dispersion 1, but changing the materials used as indicated in Table 2.

TABLE 2

| | Resin | 50% particle diameter (Dv50) on a volume basis (μm) |
|---|---|---|
| Amorphous resin fine particle dispersion 1 | Amorphous resin 1 | 0.12 |
| Amorphous resin fine particle dispersion 2 | Amorphous resin 2 | 0.12 |
| Amorphous resin fine particle dispersion 3 | Amorphous resin 3 | 0.09 |
| Amorphous resin fine particle dispersion 4 | Amorphous resin 4 | 0.20 |
| Amorphous resin fine particle dispersion 5 | Amorphous resin 5 | 0.14 |
| Amorphous resin fine particle dispersion 6 | Amorphous resin 6 | 0.16 |

<Polymer A0 Production Example>

The following materials were introduced under a nitrogen atmosphere into a reactor equipped with a reflux condenser, stirrer, thermometer, and nitrogen introduction line.

| | |
|---|---|
| solvent: toluene | 100.0 parts |
| monomer composition | 100.0 parts |

(This monomer composition was provided by mixing behenyl acrylate (monomer unit SP value: 18.25, monomer SP value: 17.69), methacrylonitrile (monomer unit SP value: 25.96, monomer SP value: 21.97), and styrene (monomer unit SP value: 20.11, monomer SP value: 17.94) in the proportions given below.)

| | |
|---|---|
| behenyl acrylate (22 carbon atoms) | 67.0 parts (28.9 mol %) |
| methacrylonitrile | 22.0 parts (53.8 mol %) |
| styrene | 11.0 parts (17.3 mol %) |
| polymerization initiator: t-butyl peroxypivalate (PERBUTYL PV, NOF Corporation) | 0.5 parts |

While stirring in the aforementioned reactor at 200 rpm, a polymerization reaction was run for 12 hours with heating to 70° C. to obtain a solution in which a polymer of the monomer composition was dissolved in toluene. This solution was then cooled to 25° C. followed by the introduction of the solution while stirring into 1000.0 parts of methanol to precipitate methanol-insoluble matter. The resulting methanol-insoluble matter was filtered off and was additionally washed with methanol, followed by vacuum drying for 24 hours at 40° C. to yield a polymer A0. The polymer A0 had a weight-average molecular weight of 68,400, an acid value of 0.0 mg KOH/g, and a melting point of 62° C.

According to the NMR analysis of polymer A0, it contained 28.9 mol % monomer unit derived from behenyl acrylate, 53.8 mol % monomer unit derived from methacrylonitrile, and 17.3 mol % monomer unit derived from styrene.

<Toner Core Dispersion Production Example>

<Toner Core Dispersion 1 (Emulsion Aggregation Method)>

[Polymer Fine Particle Dispersion E1 Production Example]

The following materials were weighed into a reactor equipped with a thermometer.

| | |
|---|---|
| deionized water | 350.0 parts |
| sodium dodecylbenzenesulfonate | 5.0 parts |
| sodium laurate | 10.0 parts |

An aqueous dispersion E1 was obtained by heating to 90° C. while stirring the reactor at 7,000 rpm using a T. K. Robomix high-speed stirrer (PRIMIX Corporation). 100.0 parts of the polymer A0 was separately dissolved in 100.0 parts of toluene at 90° C. The resulting toluene solution of the polymer A0 was introduced, with stirring under the condition indicated above, into the aqueous dispersion E1, and stirring was performed under the condition indicated above. Emulsification at a pressure of 200 MPa was also performed using a Nanomizer high-pressure impact-type disperser (Yoshida Kikai Co., Ltd.).

After removal of the toluene using an evaporator, the concentration was adjusted to 20 mass % using deionized water to yield a polymer fine particle dispersion E1 in which polymer fine particles E1 were dispersed.

The 50% particle diameter (Dv50) on a volume basis of the polymer fine particles E1 was measured at 0.40 μm using a Nanotrac UPA-EX150 dynamic light-scattering particle size distribution analyzer (Nikkiso Co., Ltd.).

[Wax Fine Particle Dispersion E1 Production Example]

The following materials were weighed into a reactor equipped with a thermometer.

| | |
|---|---|
| wax: paraffin wax (HNP-51, melting point Tm: 74° C., Nippon Seiro Co., Ltd.) | 100.0 parts |
| anionic surfactant (Neogen RK, Dai-ichi Kogyo Seiyaku Co., Ltd.) | 5.0 parts |
| deionized water | 395.0 parts |

A dispersion process was carried out for 60 minutes with heating to 90° C. while stirring the reactor at 7,000 rpm using a T. K. Robomix high-speed stirrer (PRIMIX Corporation).

The dispersion process was followed by cooling to 40° C. to obtain a wax fine particle dispersion E1 having a concentration of 20 mass %.

The 50% particle diameter (Dv50) on a volume basis of the wax fine particles was measured at 0.15 μm using a Nanotrac UPA-EX150 dynamic light-scattering particle size distribution analyzer (Nikkiso Co., Ltd.).

[Colorant Fine Particle Dispersion E1 Production Example]

| | |
|---|---|
| colorant (cyan pigment, Dainichiseika Color & Chemicals Mfg. Co., Ltd.: Pigment Blue 15:3) | 50.0 parts |
| Neogen RK anionic surfactant (Dai-ichi Kogyo Seiyaku Co., Ltd.) | 7.5 parts |
| deionized water | 442.5 parts |

These materials were weighed out, mixed, and dissolved, and dispersion was carried out for approximately 1 hour using a Nanomizer high-pressure impact-type disperser (Yoshida Kikai Co., Ltd.) to obtain an aqueous dispersion (colorant fine particle dispersion E1) in which the colorant was dispersed and the colorant fine particle concentration was 10 mass %.

The 50% particle diameter (Dv50) on a volume basis of the colorant fine particles was measured at 0.20 μm using a Nanotrac UPA-EX150 dynamic light-scattering particle size distribution analyzer (Nikkiso Co., Ltd.).

[Toner Core Production Example]

The following materials were weighed into a reactor equipped with a thermometer.

| | |
|---|---|
| polymer fine particle dispersion E1 (20 mass %) | 500.0 parts |
| wax fine particle dispersion E1 (20 mass %) | 100.0 parts |
| colorant fine particle dispersion E1 (10 mass %) | 65.0 parts |
| deionized water | 160.0 parts |

These materials were dispersed in a reactor for 10 minutes at 5,000 r/min using an Ultra-Turrax T50 homogenizer (IKA). The pH was adjusted to 3.0 by adding a 1.0% aqueous nitric acid solution; then, using a stirring blade and a heating water bath, heating to 58° C. was carried out while adjusting the rotation rate as appropriate so as to stir the mixture. At the point at which aggregated particles had been formed that had a weight-average particle diameter (D4) for the formed aggregated particles of 6.5 μm, the pH was brought to 9.0 using a 5% aqueous sodium hydroxide solution. Stirring was then continued while heating to 75° C. Aggregated particle fusion was brought about by holding for 1 hour at 75° C.

This was followed by cooling to 25° C., filtration and solid-liquid separation, and then washing with deionized water. After the completion of washing, drying using a vacuum dryer yielded a toner core 1 having a weight-average particle diameter (D4) of 6.5 μm.

[Production of Toner Core Dispersion]

| | |
|---|---|
| deionized water | 395.0 parts |
| toner core 1 | 100.0 parts |
| anionic surfactant (Neogen RK, Dai-ichi Kogyo Seiyaku Co., Ltd.) | 5.0 parts |

These materials were introduced into a beaker and a toner core dispersion 1 was obtained by stirring for 3 minutes at 3,000 rpm using a Disper (Tokushu Kika Kogyo Co., Ltd.).

<Toner Core Dispersion 2 (Pulverization Method)>

[Toner Core Production]

| | |
|---|---|
| binder resin: polymer A0 | 100.0 parts |
| colorant: Pigment Blue 15:3 | 6.5 parts |
| wax: paraffin wax (HNP-51, melting point Tm: 74° C., Nippon Seiro Co., Ltd.) | 20.0 parts |

These materials were pre-mixed using a Henschel mixer (Nippon Coke & Engineering Co., Ltd.) followed by melt-kneading with a twin-screw kneading extruder (Model PCM-30, Ikegai Ironworks Corporation).

The resulting kneaded material was cooled and coarsely pulverized using a hammer mill and was then pulverized using a mechanical pulverizer (T-250, Turbo Kogyo Co., Ltd.). The resulting finely pulverized powder was classified using a Coanda effect-based multi-grade classifier to yield a toner core 2 having a weight-average particle diameter (D4) of 6.6 μm.

[Production of Toner Core Dispersion]

| | |
|---|---|
| deionized water | 395.0 parts |
| toner core 2 | 100.0 parts |
| anionic surfactant (Neogen RK, Dai-ichi Kogyo Seiyaku Co., Ltd.) | 5.0 parts |

These materials were introduced into a beaker and a toner core dispersion 2 was obtained by stirring for 3 minutes at 3,000 rpm using a Disper (Tokushu Kika Kogyo Co., Ltd.).

<Toner Core Dispersion 3 (Dissolution Suspension Method)>

[Preparation of Fine Particle Dispersion Y1]

The following materials were introduced into a reactor equipped with a stirring rod and a thermometer.

| | |
|---|---|
| water | 683.0 parts |
| sodium salt of sulfate ester of methacrylic acid/EO adduct (Eleminol RS-30, Sanyo Chemical Industries, Ltd.) | 11.0 parts |
| styrene | 130.0 parts |
| methacrylic acid | 138.0 parts |
| n-butyl acrylate | 184.0 parts |
| ammonium persulfate | 1.0 parts |

A white suspension was obtained by stirring the reactor for 15 minutes at 400 rpm. Heating was carried out to raise the temperature in the system to 75° C. and a reaction was run for 5 hours. 30.0 parts of a 1% aqueous ammonium persulfate solution was added and maturation was carried out for 5 hours at 75° C. to obtain a fine particle dispersion Y1 of a vinyl polymer. The volume-average particle diameter of the fine particle dispersion Y1 was 0.15 μm.

[Preparation of Colorant Dispersion Y1]

| | |
|---|---|
| C.I. Pigment Blue 15:3 | 100.0 parts |
| ethyl acetate | 150.0 parts |
| glass beads (1 mm) | 200.0 parts |

These materials were introduced into a heat-resistant glass vessel; dispersion was performed for 5 hours using a paint shaker; and the glass beads were removed using a nylon mesh to yield a colorant dispersion Y1.

[Preparation of Wax Dispersion Y1]

| | |
|---|---|
| wax: paraffin wax (HNP-51, melting point Tm: 74° C., Nippon Seiro Co., Ltd.) | 20.0 parts |
| ethyl acetate | 80.0 parts |

The preceding components were introduced into a sealable reactor and were stirred and heated at 80° C. Then, while gently stirring the system at 50 rpm, cooling to 25° C. was performed over 3 hours to yield a milky white liquid.

This solution was introduced into a heat-resistant vessel together with 30.0 parts of glass beads having a diameter of 1 mm; dispersion was carried out for 3 hours using a paint shaker (Toyo Seiki Seisaku-sho Ltd.); and the glass beads were removed using a nylon mesh to yield a wax dispersion Y1.

[Preparation of Oil Phase Y1]

| | |
|---|---|
| polymer A0 | 100.0 parts |
| ethyl acetate | 85.0 parts |

These materials were introduced into a beaker and stirring was carried out for 1 minute at 3,000 rpm using a Disper (Tokushu Kika Kogyo Co., Ltd.).

| | |
|---|---|
| wax dispersion Y1 (20 mass % solids fraction) | 50.0 parts |
| colorant dispersion Y1 (40 mass % solids fraction) | 12.5 parts |
| ethyl acetate | 5.0 parts |

These materials were introduced into a beaker and an oil phase Y1 was prepared by stirring for 3 minutes at 6,000 rpm using a Disper (Tokushu Kika Kogyo Co., Ltd.).

[Preparation of Aqueous Phase Y1]

| | |
|---|---|
| fine particle dispersion Y1 | 15.0 parts |
| aqueous sodium dodecyl diphenyl ether disulfonate solution (Eleminol MON7, Sanyo Chemical Industries, Ltd.) | 30.0 parts |
| deionized water | 955.0 parts |

These materials were introduced into a beaker and an aqueous phase Y1 was prepared by stirring for 3 minutes at 3,000 rpm using a Disper (Tokushu Kika Kogyo Co., Ltd.).

[Toner Core Production]

The oil phase Y1 was introduced into the aqueous phase Y1 and dispersion was carried out for 10 minutes at a rotation rate of 10,000 rpm using a T. K. Homomixer (Tokushu Kika Kogyo Co., Ltd.). This was followed by solvent removal for 30 minutes at 30° C. under a reduced pressure of 50 mmHg. Filtration was then performed, and the process of filtration and redispersion in deionized water was repeated until the conductivity of the slurry reached 100 μS to remove the surfactant and yield a filter cake.

The filter cake was vacuum dried and then subjected to air classification to obtain a toner core 3 having a weight-average particle diameter (D4) of 6.6 μm.

[Production of Toner Core Dispersion]

| | |
|---|---|
| deionized water | 395.0 parts |
| toner core 3 | 100.0 parts |
| anionic surfactant (Neogen RK, Dai-ichi Kogyo Seiyaku Co., Ltd.) | 5.0 parts |

These materials were introduced into a beaker and a toner core dispersion 3 was obtained by stirring for 3 minutes at 3,000 rpm using a Disper (Tokushu Kika Kogyo Co., Ltd.).

[Toner Production Examples]

<Toner 1>

A mixture of the following components was prepared.

| | |
|---|---|
| monomer composition | 100.0 parts |

(This monomer composition was provided by mixing behenyl acrylate (monomer unit SP value: 18.25, monomer SP value: 17.69), methacrylonitrile (monomer unit SP value: 25.96, monomer SP value: 21.97), and styrene (monomer unit SP value: 20.11, monomer SP value: 17.94) in the proportions given below.)

| | |
|---|---|
| behenyl acrylate | 67.0 parts (28.9 mol %) |
| methacrylonitrile | 22.0 parts (53.8 mol %) |
| styrene | 11.0 parts (17.3 mol %) |
| colorant: Pigment Blue 15:3 | 6.5 parts |
| amorphous resin 1 | 4.0 parts |
| wax: paraffin wax (HNP-51, melting point Tm: 74° C., Nippon Seiro Co., Ltd.) | 20.0 parts |
| toluene | 100.0 parts |

This mixture was introduced into an attritor (Nippon Coke & Engineering Co., Ltd.), and a starting material dispersion was obtained by dispersing for 2 hours at 200 rpm using zirconia beads having a diameter of 5 mm.

Otherwise, 735.0 parts of deionized water and 16.0 parts of trisodium phosphate (dodecahydrate) were added to a vessel equipped with a Homomixer high-speed stirrer (PRIMIX Corporation) and a thermometer, and the temperature was raised to 60° C. while stirring at 12,000 rpm. To this was added an aqueous calcium chloride solution of 9.0 parts calcium chloride (dihydrate) dissolved in 65.0 parts deionized water, and stirring was carried out for 30 minutes at 12,000 rpm while maintaining 60° C. To this was added 10% hydrochloric acid to adjust the pH to 6.0 and obtain an aqueous dispersion in which a hydroxyapatite-containing inorganic dispersion stabilizer was dispersed in water.

The starting material dispersion was transferred to a vessel equipped with a stirrer and thermometer, and the temperature was raised to 60° C. while stirring at 100 rpm. To this was added 8.0 parts of the polymerization initiator t-butyl peroxypivalate (PERBUTYL PV, NOF Corporation); stirring was performed for 5 minutes at 100 rpm while holding at 60° C.; and this was introduced into the aqueous dispersion that was being stirred at 12,000 rpm with the high-speed stirrer. A granulation solution was obtained by continuing to stir for 20 minutes at 12,000 rpm with the high-speed stirrer while holding at 60° C.

The granulation solution was transferred to a reactor equipped with a reflux condenser, stirrer, thermometer, and nitrogen introduction line, and the temperature was raised to 70° C. while stirring at 150 rpm under a nitrogen atmosphere. A polymerization reaction was run for 10 hours at 150 rpm while holding at 70° C. This was followed by removal of the reflux condenser from the reactor; raising the temperature of the reaction solution to 95° C.; and removing the toluene by stirring for 5 hours at 150 rpm while holding at 95° C. to yield a toner particle dispersion.

The resulting toner particle dispersion was cooled to 20° C. while stirring at 150 rpm, and, while maintaining this stirring, dilute hydrochloric acid was then added to bring the pH to 1.5 and dissolve the dispersion stabilizer. The solid fraction was filtered off and thoroughly washed with deionized water, followed by vacuum drying for 24 hours at 40° C. to obtain a toner particle 1 containing a polymer A1 of the monomer composition.

2.0 parts of silica fine particles (hydrophobically treated with hexamethyldisilazane, number-average primary particle diameter: 10 nm, BET specific surface area: 170 $m^2/g$) as an external additive was added per 100.0 parts of the obtained toner particle 1, and mixing was carried out for 15 minutes at 3,000 rpm using a Henschel mixer (Nippon Coke & Engineering Co., Ltd.) to obtain a toner 1. The properties of the toner 1 are given in Tables 5-1 and 5-2 and Table 6.

In addition, a polymer a1 was obtained by carrying out the same production as in the production example for toner 1, but omitting the colorant, amorphous resin, and wax. The polymer a1 had a weight-average molecular weight of 56,000, an acid value of 0.0 mg KOH/g, and a melting point of 62° C. Analysis of the polymer a1 by NMR gave a content of 28.9 mol % for the monomer unit derived from behenyl acrylate, 53.8 mol % for the monomer unit derived from methacrylonitrile, and 17.3 mol % for the monomer unit derived from styrene. The property values of the polymer a1 were taken to be the property values of the polymer A1.

<Toners 9, 10, 13 to 36, 38, and 41 to 47>

Toners 9, 10, 13 to 36, 38, and 41 to 47 were obtained proceeding as in the production example for toner 1, but changing the materials used as shown in Table 3. In the production examples for toners 27 and 28, 1.5 parts of t-butyl peroxy-2-ethylhexanoate (PERBUTYL O, NOF Corporation) was added to the reaction solution prior to raising the temperature of the reaction solution to 95° C. The properties of the obtained toners are given in Tables 5-1 and 5-2 and Table 6. The SP values of the monomers used are given in Table 7.

<Toner 2>

The following materials were weighed into a reactor equipped with a thermometer.

| | |
|---|---|
| toner core dispersion 1 (20 mass %) | 500.0 parts |
| amorphous resin fine particle dispersion 1 (20 mass %) | 30.0 parts |

These materials were dispersed in a reactor for 10 minutes at 5,000 rpm using an Ultra-Turrax T50 homogenizer (IKA). The pH was adjusted to 3.0 by adding a 1.0% aqueous nitric acid solution; then, using a stirring blade and a heating water bath, heating to 58° C. was carried out while adjusting the rotation rate as appropriate so as to stir the mixture; and attachment of the amorphous resin fine particles to the toner core was brought about. At the point at which particles had been formed that had a weight-average particle diameter (D4) for the formed aggregated particles of 6.7 μm, the pH was brought to 9.0 using a 5% aqueous sodium hydroxide solution. Stirring was then continued while heating to 75° C. Aggregated particle fusion was brought about by holding for 1 hour at 75° C.

This was followed by cooling to 25° C., filtration and solid-liquid separation, and then washing with deionized water. After the completion of washing, drying using a vacuum dryer yielded a toner particle 2 having a weight-average particle diameter (D4) of 6.7 μm.

2.0 parts of silica fine particles (hydrophobically treated with hexamethyldisilazane, number-average primary particle diameter: 10 nm, BET specific surface area: 170 $m^2/g$) as an external additive was added per 100.0 parts of the obtained toner particle 2, and mixing was carried out for 15 minutes at 3,000 rpm using a Henschel mixer (Nippon Coke & Engineering Co., Ltd.) to obtain a toner 2. The properties of the toner 2 are given in Tables 5-1 and 5-2 and Table 6.

<Toners 3 to 5, 7, 8, 11, 12, 39, and 40>

Toners 3 to 5, 7, 8, 11, 12, 39, and 40 were obtained proceeding as in the production example for toner 2, but changing the materials and conditions used as shown in Table 4. The properties are given in Tables 5-1 and 5-2 and Table 6.

<Toner 6>

The following materials were weighed into a reactor equipped with a stirrer and thermometer.

toner core dispersion 2 500.0 parts

The contents of the reactor were adjusted to pH 4 with a 1 mol/L aqueous p-toluenesulfonic acid solution. To this liquid was added 4 parts of an aqueous solution of hexamethylolmelamine prepolymer (Mirbane Resin SM-607 (solids concentration=80 mass %), Showa Denko Kabushiki Kaisha). An additional 300.0 parts of deionized water was added while stirring; the temperature was raised at a rate of 1° C./min while stirring; and holding was carried out for 2 hours at 70° C. This was followed by cooling to room temperature and adjustment of the pH to 7. Filtration, washing, drying, and classification gave a toner particle 6 having a weight-average particle diameter (D4) of 6.6 μm.

3.0 parts of silica fine particles (hydrophobically treated with hexamethyldisilazane, number-average primary particle diameter: 10 nm, BET specific surface area: 170 $m^2/g$) as an external additive was added per 100.0 parts of the obtained toner particle 6, and mixing was carried out for 15 minutes at 3,000 rpm using a Henschel mixer (Nippon Coke & Engineering Co., Ltd.) to obtain a toner 6. The properties of the toner 6 are given in Tables 5-1 and 5-2 and Table 6.

<Toner 37>

2.0 parts of silica fine particles (hydrophobically treated with hexamethyldisilazane, number-average primary particle diameter: 10 nm, BET specific surface area: 170 $m^2/g$) as an external additive was added per 100.0 parts of toner core 1, and mixing was carried out for 15 minutes at 3,000 rpm using a Henschel mixer (Nippon Coke & Engineering Co., Ltd.) to obtain a toner 37. The properties of the toner 37 are given in Tables 5-1 and 5-2 and Table 6.

TABLE 3

| Toner | First polymerizable monomer | | Second polymerizable monomer | | Third polymerizable monomer | | Resin | | Wax | |
|---|---|---|---|---|---|---|---|---|---|---|
| No. | Type | Parts | Type | Parts | Type | Parts | Type | Parts | Type | Parts |
| 1 | Behenyl acrylate | 67.0 | Methacrylonitrile | 22.0 | Styrene | 11.0 | Amorphous resin 1 | 4.0 | HNP-51 | 20.0 |
| 9 | Behenyl acrylate | 67.0 | Methacrylonitrile | 22.0 | Styrene | 11.0 | Amorphous resin 1 | 0.4 | HNP-51 | 20.0 |
| 10 | Behenyl acrylate | 67.0 | Methacrylonitrile | 22.0 | Styrene | 11.0 | Amorphous resin 1 | 1.0 | HNP-51 | 20.0 |
| 13 | Stearyl acrylate | 67.0 | Methacrylonitrile | 22.0 | Styrene | 11.0 | Amorphous resin 1 | 4.0 | HNP-51 | 20.0 |
| 14 | Myricyl acrylate | 67.0 | Methacrylonitrile | 22.0 | Styrene | 11.0 | Amorphous resin 1 | 4.0 | HNP-51 | 20.0 |
| 15 | Behenyl acrylate | 34.0 | Methacrylonitrile | 22.0 | Styrene | 11.0 | Amorphous resin 1 | 4.0 | HNP-51 | 20.0 |
| | Behenyl methacrylate | 33.0 | | | | | | | | |

TABLE 3-continued

| Toner | First polymerizable monomer | | Second polymerizable monomer | | Third polymerizable monomer | | Resin | | Wax | |
|---|---|---|---|---|---|---|---|---|---|---|
| No. | Type | Parts | Type | Parts | Type | Parts | Type | Parts | Type | Parts |
| 16 | Behenyl acrylate | 89.0 | Methacrylonitrile | 11.0 | Styrene | 0.0 | Amorphous resin 1 | 4.0 | HNP-51 | 20.0 |
| 17 | Behenyl acrylate | 40.0 | Methacrylonitrile | 40.0 | Styrene | 20.0 | Amorphous resin 1 | 4.0 | HNP-51 | 20.0 |
| 18 | Behenyl acrylate | 40.0 | Methacrylonitrile | 60.0 | Styrene | 0.0 | Amorphous resin 1 | 4.0 | HNP-51 | 20.0 |
| 19 | Behenyl acrylate | 34.0 | Methacrylonitrile | 11.0 | Styrene | 55.0 | Amorphous resin 1 | 4.0 | HNP-51 | 20.0 |
| 20 | Behenyl acrylate | 67.0 | Acrylonitrile | 22.0 | Styrene | 11.0 | Amorphous resin 1 | 4.0 | HNP-51 | 20.0 |
| 21 | Behenyl acrylate | 50.0 | 2-HPMA | 40.0 | Styrene | 10.0 | Amorphous resin 1 | 4.0 | HNP-51 | 20.0 |
| 22 | Behenyl acrylate | 65.0 | Acrylamide | 25.0 | Styrene | 10.0 | Amorphous resin 1 | 4.0 | HNP-51 | 20.0 |
| 23 | Behenyl acrylate | 40.0 | Acrylonitrile | 27.5 | Styrene | 30.0 | Amorphous resin 1 | 4.0 | HNP-51 | 20.0 |
| | | | Urethane group-containing monomer | 2.5 | | | | | | |
| 24 | Behenyl acrylate | 40.0 | Acrylonitrile | 27.5 | Styrene | 30.0 | Amorphous resin 1 | 4.0 | HNP-51 | 20.0 |
| | | | Urea group-containing monomer | 2.5 | | | | | | |
| 25 | Behenyl acrylate | 60.0 | Vinyl acetate | 30.0 | Styrene | 10.0 | Amorphous resin 1 | 4.0 | HNP-51 | 20.0 |
| 26 | Behenyl acrylate | 60.0 | Methyl acrylate | 30.0 | Styrene | 10.0 | Amorphous resin 1 | 4.0 | HNP-51 | 20.0 |
| 27 | Behenyl acrylate | 25.0 | Vinyl acetate | 75.0 | — | 0.0 | Amorphous resin 1 | 4.0 | HNP-51 | 10.0 |
| 28 | Behenyl acrylate | 25.0 | Vinyl acetate | 75.0 | — | 0.0 | Amorphous resin 1 | 4.0 | DP-18 | 10.0 |
| 29 | Behenyl acrylate | 67.0 | Methacrylonitrile | 22.0 | Styrene | 11.0 | Amorphous resin 3 | 10.0 | HNP-51 | 70.0 |
| 30 | Behenyl acrylate | 67.0 | Methacrylonitrile | 22.0 | Styrene | 11.0 | Amorphous resin 3 | 10.0 | HNP-51 | 40.0 |
| 31 | Behenyl acrylate | 67.0 | Methacrylonitrile | 22.0 | Styrene | 11.0 | Amorphous resin 3 | 10.0 | HNP-51 | 15.0 |
| 32 | Behenyl acrylate | 67.0 | Methacrylonitrile | 22.0 | Styrene | 11.0 | Amorphous resin 3 | 10.0 | HNP-51 | 10.0 |
| 33 | Behenyl acrylate | 61.0 | Methacrylonitrile | 9.0 | Styrene | 30.0 | Amorphous resin 3 | 10.0 | HNP-51 | 10.0 |
| 34 | Behenyl acrylate | 61.0 | Methacrylonitrile | 5.5 | Styrene | 30.0 | Amorphous resin 3 | 10.0 | HNP-51 | 10.0 |
| | | | Acrylic acid | 3.5 | | | | | | |
| 35 | Behenyl acrylate | 61.0 | Methacrylonitrile | 4.5 | Styrene | 30.0 | Amorphous resin 3 | 10.0 | HNP-51 | 10.0 |
| | | | Acrylic acid | 4.5 | | | | | | |
| 36 | Behenyl acrylate | 61.0 | Acrylic acid | 9.0 | Styrene | 30.0 | Amorphous resin 3 | 10.0 | HNP-51 | 10.0 |
| 38 | Behenyl acrylate | 61.0 | Methacrylonitrile | 9.0 | Styrene | 30.0 | Crystalline resin 1 | 10.0 | HNP-51 | 10.0 |
| 41 | Behenyl acrylate | 66.6 | Acrylic acid | 4.8 | Methyl methacrylate | 28.6 | Amorphous resin 3 | 10.0 | HNP-51 | 9.0 |
| 42 | Behenyl acrylate | 20.0 | Methacrylonitrile | 53.0 | Styrene | 27.0 | Amorphous resin 1 | 4.0 | HNP-51 | 10.0 |
| 43 | Behenyl acrylate | 90.0 | Methacrylonitrile | 10.0 | — | 0.0 | Amorphous resin 1 | 4.0 | HNP-51 | 10.0 |
| 44 | Behenyl acrylate | 61.0 | Methacrylonitrile | 7.0 | Styrene | 32.0 | Amorphous resin 1 | 4.0 | HNP-51 | 10.0 |
| 45 | Behenyl acrylate | 20.0 | Methacrylonitrile | 80.0 | — | 0.0 | Amorphous resin 1 | 4.0 | HNP-51 | 10.0 |
| 46 | Hexadecyl acrylate | 61.0 | Methacrylonitrile | 26.0 | Styrene | 13.0 | Amorphous resin 1 | 4.0 | HNP-51 | 10.0 |
| 47 | Behenyl acrylate | 60.0 | — | — | Methyl methacrylate | 29.0 | Amorphous resin 1 | 4.0 | HNP-51 | 10.0 |
| | | | | | Styrene | 11.0 | | | | |
| 48 | Behenyl acrylate | 66.6 | Acrylic acid | 4.8 | Methyl methacrylate | 28.6 | Amorphous resin 3 | 10.0 | HNP-51 | 20.0 |

(In Table 3, DP-18 represents dipentaerythritol hexastearate and 2-HPMA represents 2-hydroxypropyl methacrylate.)

TABLE 4

| Toner | Toner core dispersion | Amorphous resin fine particle dispersion: Type | Amount of addition (parts) | Fusion step: Temperature (° C.) | Time (h) |
|---|---|---|---|---|---|
| 2 | 1 | 1 | 30.0 | 75 | 1 |
| 3 | 2 | 1 | 30.0 | 75 | 1 |
| 4 | 3 | 1 | 30.0 | 75 | 1 |
| 5 | 1 | 2 | 30.0 | 75 | 1 |
| 7 | 1 | 3 | 30.0 | 95 | 1 |

TABLE 4-continued

| Toner | Toner core dispersion | Amorphous resin fine particle dispersion: Type | Amount of addition (parts) | Fusion step: Temperature (° C.) | Time (h) |
|---|---|---|---|---|---|
| 8 | 1 | 4 | 15.0 | 95 | 1 |
| | | 5 | 15.0 | | |
| 11 | 1 | 1 | 100.0 | 75 | 1 |
| 12 | 1 | 1 | 125.0 | 75 | 1 |
| 39 | 1 | 1 | 30.0 | 75 | 0.1 |
| 40 | 1 | 5 | 15.0 | 95 | 1 |
| | | 6 | 15.0 | | |

TABLE 5-1

| Toner | PolymerA: Monomer unit derived from first polymerizable monomer | | | | Monomer unit derived from second polymerizable monomer | | | Monomer unit derived from third polymerizable monomer | |
|---|---|---|---|---|---|---|---|---|---|
| No. | Type | Number of carbon | mol % | Parts | Type | Structure | mol % | Type | mol % |
| 1 | Behenyl acrylate | 22 | 28.9 | 67.0 | Methacrylonitrile | Formula (A) | 53.8 | Styrene | 17.3 |
| 2 | Behenyl acrylate | 22 | 28.9 | 67.0 | Methacrylonitrile | Formula (A) | 53.8 | Styrene | 17.3 |
| 3 | Behenyl acrylate | 22 | 28.9 | 67.0 | Methacrylonitrile | Formula (A) | 53.8 | Styrene | 17.3 |

TABLE 5-1-continued

| Toner | PolymerA | | | | | | | | |
|---|---|---|---|---|---|---|---|---|---|
| | Monomer unit derived from first polymerizable monomer | | | | Monomer unit derived from second polymerizable monomer | | | Monomer unit derived from third polymerizable monomer | |
| No. | Type | Number of carbon | mol % | Parts | Type | Structure | mol % | Type | mol % |
| 4 | Behenyl acrylate | 22 | 28.9 | 67.0 | Methacrylonitrile | Formula (A) | 53.8 | Styrene | 17.3 |
| 5 | Behenyl acrylate | 22 | 28.9 | 67.0 | Methacrylonitrile | Formula (A) | 53.8 | Styrene | 17.3 |
| 6 | Behenyl acrylate | 22 | 28.9 | 67.0 | Methacrylonitrile | Formula (A) | 53.8 | Styrene | 17.3 |
| 7 | Behenyl acrylate | 22 | 28.9 | 67.0 | Methacrylonitrile | Formula (A) | 53.8 | Styrene | 17.3 |
| 8 | Behenyl acrylate | 22 | 28.9 | 67.0 | Methacrylonitrile | Formula (A) | 53.8 | Styrene | 17.3 |
| 9 | Behenyl acrylate | 22 | 28.9 | 67.0 | Methacrylonitrile | Formula (A) | 53.8 | Styrene | 17.3 |
| 10 | Behenyl acrylate | 22 | 28.9 | 67.0 | Methacrylonitrile | Formula (A) | 53.8 | Styrene | 17.3 |
| 11 | Behenyl acrylate | 22 | 28.9 | 67.0 | Methacrylonitrile | Formula (A) | 53.8 | Styrene | 17.3 |
| 12 | Behenyl acrylate | 22 | 28.9 | 67.0 | Methacrylonitrile | Formula (A) | 53.8 | Styrene | 17.3 |
| 13 | Stearyf acrylate | 18 | 32.3 | 67.0 | Methacrylonitrile | Formula (A) | 51.2 | Styrene | 16.5 |
| 14 | Myricyf acrylate | 30 | 23.9 | 67.0 | Methacrylonitrile | Formula (A) | 57.6 | Styrene | 18.5 |
| 15 | Behenyl acrylate | 22 | 14.3 | 34.0 | Methacrylonitrile | Formula (A) | 54.1 | Styrene | 17.4 |
| | Behenyl methacrylate | 22 | 14.2 | 33.0 | | | | | |
| 16 | Behenyl acrylate | 22 | 58.8 | 89.0 | Methacrylonitrile | Formula (A) | 41.2 | — | 0.0 |
| 17 | Behenyl acrylate | 22 | 11.8 | 40.0 | Methacrylonitrile | Formula (A) | 66.7 | Styrene | 21.5 |
| 18 | Behenyl acrylate | 22 | 10.5 | 40.0 | Methacrylonitrile | Formula (A) | 89.5 | — | 0.0 |
| 19 | Behenyl acrylate | 22 | 11.4 | 34.0 | Methacrylonitrile | Formula (A) | 21.0 | Styrene | 67.6 |
| 20 | Behenyl acrylate | 22 | 25.3 | 67.0 | Acrylonitrile | Formula (A) | 59.5 | Styrene | 15.2 |
| 21 | Behenyl acrylate | 22 | 26.0 | 50.0 | 2-HPMA | Formula (A) | 55.0 | Styrene | 19.0 |
| 22 | Behenyl acrylate | 22 | 27.6 | 65.0 | Acrylamide | Formula (A) | 56.9 | Styrene | 15.5 |
| 23 | Behenyl acrylate | 22 | 11.4 | 40.0 | Acrylonitrile | Formula (A) | 57.4 | Styrene | 31.2 |
| | | | | | Urethane group-containing monomer | Formula (A) | | | |
| 24 | Behenyl acrylate | 22 | 11.4 | 40.0 | Acrylonitrile | Formula (A) | 57.3 | Styrene | 31.2 |
| | | | | | Urea group-containing monomer | Formula (A) | | | |
| 25 | Behenyl acrylate | 22 | 26.2 | 60.0 | Vinyl acetate | Formula (B) | 57.9 | Styrene | 15.9 |
| 26 | Behenyl acrylate | 22 | 26.2 | 60.0 | Methyl acrylate | Formula (A) | 57.9 | Styrene | 15.9 |
| 27 | Behenyl acrylate | 22 | 7.0 | 25.0 | Vinyl acetate | Formula (B) | 93.0 | — | 0.0 |
| 28 | Behenyl acrylate | 22 | 7.0 | 25.0 | Vinyl acetate | Formula (B) | 93.0 | — | 0.0 |
| 29 | Behenyl acrylate | 22 | 28.9 | 67.0 | Methacrylonitrile | Formula (A) | 53.8 | Styrene | 17.3 |
| 30 | Behenyl acrylate | 22 | 28.9 | 67.0 | Methacrylonitrile | Formula (A) | 53.8 | Styrene | 17.3 |
| 31 | Behenyl acrylate | 22 | 28.9 | 67.0 | Methacrylonitrile | Formula (A) | 53.8 | Styrene | 17.3 |
| 32 | Behenyl acrylate | 22 | 28.9 | 67.0 | Methacrylonitrile | Formula (A) | 53.8 | Styrene | 17.3 |
| 33 | Behenyl acrylate | 22 | 27.5 | 61.0 | Methacrylonitrile | Formula (A) | 23.0 | Styrene | 49.5 |
| 34 | Behenyl acrylate | 22 | 27.1 | 61.0 | Methacrylonitrile | Formula (A) | 22.2 | Styrene | 50.7 |
| | | | | | Acrylic acid | Formula (A) | | | |
| 35 | Behenyl acrylate | 22 | 27.2 | 61.0 | Methacrylonitrile | Formula (A) | 22.0 | Styrene | 50.8 |
| | | | | | Acrylic acid | Formula (A) | | | |
| 36 | Behenyl acrylate | 22 | 27.4 | 61.0 | Acrylic acid | Formula (A) | 21.4 | Styrene | 51.2 |
| 37 | Behenyl acrylate | 22 | 28.9 | 67.0 | Methacrylonitrile | Formula (A) | 53.8 | Styrene | 17.3 |
| 38 | Behenyl acrylate | 22 | 27.5 | 61.0 | Methacrylonitrile | Formula (A) | 23.0 | Styrene | 49.5 |
| 39 | Behenyl acrylate | 22 | 28.9 | 67.0 | Methacrylonitrile | Formula (A) | 53.8 | Styrene | 17.3 |
| 40 | Behenyl acrylate | 22 | 28.9 | 67.0 | Methacrylonitrile | Formula (A) | 53.8 | Styrene | 17.3 |
| 41 | Behenyl acrylate | 22 | 33.2 | 66.6 | Acrylic acid | Formula (A) | 12.6 | Methyl methacrylate | 54.2 |
| 42 | Behenyl acrylate | 22 | 4.8 | 20.0 | Methacrylonitrile | Formula (A) | 71.7 | Styrene | 23.5 |
| 43 | Behenyl acrylate | 22 | 61.3 | 90.0 | Methacrylonitrile | Formula (A) | 38.7 | — | 0.0 |
| 44 | Behenyl acrylate | 22 | 28.0 | 61.0 | Methacrylonitrile | Formula (A) | 18.2 | Styrene | 53.8 |
| 45 | Behenyl acrylate | 22 | 4.2 | 20.0 | Methacrylonitrile | Formula (A) | 95.8 | — | 0.0 |
| 46 | Hexadecyl acrylate | 16 | 28.6 | 61.0 | Methacrylonitrile | Formula (A) | 54.0 | Styrene | 17.4 |
| 47 | Behenyl acrylate | 22 | 28.5 | 60.0 | — | — | — | Methyl methacrylate | 52.4 |
| | | | | | | | | Styrene | 19.1 |
| 48 | Behenyl acrylate | 22 | 33.2 | 66.6 | Acrylic acid | Formula (A) | 12.6 | Methyl methacrylate | 54.2 |

(In Table 5-1, 2-HPMA represents 2-hydroxypropyl methacrylate.)

TABLE 5-2

| | Polymer A | | | | | |
|---|---|---|---|---|---|---|
| | $SP_{21} - SP_{1.1}$ Unit | $SP_{22} - SP_{12}$ Monomer | Weight-average molecular weight | Acid value (mgKOH/g) | Melting point (° C.) | Charge decayrate |
| Toner 1 | 7.71 | 4.28 | 56000 | 0.0 | 62 | 9 |
| Toner 2 | 7.71 | 4.28 | 68400 | 0.0 | 62 | 9 |
| Toner 3 | 7.71 | 4.28 | 68400 | 0.0 | 62 | 9 |
| Toner 4 | 7.71 | 4.28 | 68400 | 0.0 | 62 | 9 |

TABLE 5-2-continued

| | Polymer A | | | | | |
|---|---|---|---|---|---|---|
| | $SP_{21} - SP_{1.1}$ Unit | $SP_{22} - SP_{12}$ Monomer | Weight-average molecular weight | Acid value (mgKOH/g) | Melting point (° C.) | Charge decayrate |
| Toner 5 | 7.71 | 4.28 | 68400 | 0.0 | 62 | 9 |
| Toner 6 | 7.71 | 4.28 | 68400 | 0.0 | 62 | 9 |
| Toner 7 | 7.71 | 4.28 | 68400 | 0.0 | 62 | 9 |
| Toner 8 | 7.71 | 4.28 | 68400 | 0.0 | 62 | 9 |
| Toner 9 | 7.71 | 4.28 | 56000 | 0.0 | 62 | 15 |
| Toner 10 | 7.71 | 4.28 | 56000 | 0.0 | 62 | 10 |
| Toner 11 | 7.71 | 4.28 | 56000 | 0.0 | 62 | 8 |
| Toner 12 | 7.71 | 4.28 | 56000 | 0.0 | 62 | 7 |
| Toner 13 | 7.57 | 4.26 | 55400 | 0.0 | 54 | 15 |
| Toner 14 | 7.88 | 4.32 | 51800 | 0.0 | 76 | 7 |
| Toner 15 | 7.79 | 4.32 | 55200 | 0.0 | 63 | 10 |
| Toner 16 | 7.71 | 4.28 | 54800 | 0.0 | 62 | 24 |
| Toner 17 | 7.71 | 4.28 | 54200 | 0.0 | 55 | 10 |
| Toner 18 | 7.71 | 4.28 | 57800 | 0.0 | 56 | 10 |
| Toner 19 | 7.71 | 4.28 | 53400 | 0.0 | 53 | 55 |
| Toner 20 | 11.18 | 5.06 | 55500 | 0.0 | 62 | 9 |
| Toner 21 | 5.87 | 5.26 | 53400 | 0.0 | 59 | 8 |
| Toner 22 | 21.00 | 11.44 | 56800 | 0.0 | 59 | 9 |
| Toner 23 | 11.18 | 5.05 | 53600 | 0.0 | 55 | 12 |
| | 5.54 | 4.21 | | | | |
| Toner 24 | 11.18 | 5.05 | 55400 | 0.0 | 55 | 13 |
| | 3.50 | 3.17 | | | | |
| Toner 25 | 3.35 | 0.62 | 53600 | 0.0 | 56 | 9 |
| Toner 26 | 3.35 | 0.62 | 54700 | 0.0 | 54 | 42 |
| Toner 27 | 3.35 | 0.62 | 54000 | 0.0 | 59 | 9 |
| Toner 28 | 3.35 | 0.62 | 55200 | 0.0 | 59 | 10 |
| Toner 29 | 7.71 | 4.28 | 56000 | 0.0 | 62 | 12 |
| Toner 30 | 7.71 | 4.28 | 56000 | 0.0 | 62 | 9 |
| Toner 31 | 7.71 | 4.28 | 56000 | 0.0 | 62 | 9 |
| Toner 32 | 7.71 | 4.28 | 56000 | 0.0 | 62 | 9 |
| Toner 33 | 7.71 | 4.28 | 53900 | 0.0 | 57 | 33 |
| Toner 34 | 7.71 | 4.28 | 55200 | 27.7 | 57 | 38 |
| | 10.47 | 4.97 | | | | |
| Toner 35 | 7.71 | 4.28 | 56400 | 35.5 | 57 | 56 |
| | 10.47 | 4.97 | | | | |
| Toner 36 | 10.47 | 4.97 | 57100 | 70.0 | 57 | 105 |
| Toner 37 | 7.71 | 4.28 | 68400 | 0.0 | 62 | 9 |
| Toner 38 | 7.71 | 4.28 | 53900 | 0.0 | 57 | 33 |
| Toner 39 | 7.71 | 4.28 | 68400 | 0.0 | 62 | 9 |
| Toner 40 | 7.71 | 4.28 | 68400 | 0.0 | 62 | 9 |
| Toner 41 | 10.47 | 4.97 | 52700 | 37.3 | 56 | 175 |
| Toner 42 | 7.71 | 4.28 | 54500 | 0.0 | 55 | 7 |
| Toner 43 | 7.71 | 4.28 | 55800 | 0.0 | 62 | 253 |
| Toner 44 | 7.71 | 4.28 | 52900 | 0.0 | 56 | 42 |
| Toner 45 | 7.71 | 4.28 | 56300 | 0.0 | 55 | 7 |
| Toner 46 | 7.49 | 4.23 | 52200 | 0.0 | 45 | 8 |
| Toner 47 | — | — | 56500 | 0.0 | 52 | 142 |
| Toner 48 | 10.47 | 4.97 | 52700 | 37.3 | 56 | 175 |

TABLE 6

| | Shell | | | | | | Wax | Toner | |
|---|---|---|---|---|---|---|---|---|---|
| | Type | Classification | Structure | Coverage ratio (%) | Thickness (nm) | $SP_{S1} - SP_{S2}$ | Amount (parts) | (J/g) | D4 (μm) |
| Toner 1 | Amorphous resin 1 | Polyester | Alternating copolymer | 99 | 16.2 | — | 20.0 | 65.6 | 6.6 |
| Toner 2 | Amorphous resin 1 | Polyester | Alternating copolymer | 99 | 29.2 | — | 20.0 | 66.4 | 6.7 |
| Toner 3 | Amorphous resin 1 | Polyester | Alternating copolymer | 99 | 28.7 | — | 20.0 | 65.3 | 6.6 |
| Toner 4 | Amorphous resin 1 | Polyester | Alternating copolymer | 99 | 30.6 | — | 20.0 | 67.8 | 6.7 |
| Toner 5 | Amorphous resin 2 | Polyester | Random copolymer | 99 | 29.1 | — | 20.0 | 62.2 | 6.7 |
| Toner 6 | — | Melamine | Alternating copolymer | 99 | 12.1 | — | 20.0 | 66.7 | 6.6 |
| Toner 7 | Amorphous resin 3 | Vinyl | Random copolymer | 99 | 29.1 | — | 20.0 | 65.6 | 6.6 |
| Toner 8 | Amorphous resin 4 | Vinyl | Homopolymer | 99 | 30.1 | 1.4 | 20.0 | 64.5 | 6.6 |
| | Amorphous resin 5 | Vinyl | Homopolymer | | | | | | |
| Toner 9 | Amorphous resin 1 | Polyester | Alternating copolymer | 92 | 1.6 | — | 20.0 | 65.0 | 7.1 |
| Toner 10 | Amorphous resin 1 | Polyester | Alternating copolymer | 96 | 3.8 | — | 20.0 | 62.8 | 6.9 |
| Toner 11 | Amorphous resin 1 | Polyester | Alternating copolymer | 99 | 91.2 | — | 20.0 | 65.8 | 6.8 |
| Toner 12 | Amorphous resin 1 | Polyester | Alternating copolymer | 99 | 109.6 | — | 20.0 | 65.8 | 6.9 |
| Toner 13 | Amorphous resin 1 | Polyester | Alternating copolymer | 99 | 16.5 | — | 20.0 | 67.4 | 6.5 |
| Toner 14 | Amorphous resin 1 | Polyester | Alternating copolymer | 99 | 15.8 | — | 20.0 | 67.6 | 6.6 |
| Toner 15 | Amorphous resin 1 | Polyester | Alternating copolymer | 99 | 15.4 | — | 20.0 | 65.6 | 6.7 |

TABLE 6-continued

| | Shell | | | | | | Wax | Toner | |
|---|---|---|---|---|---|---|---|---|---|
| | Type | Classification | Structure | Coverage ratio (%) | Thickness (nm) | $SP_{S1} - SP_{S2}$ | Amount (parts) | (J/g) | D4 (μm) |
| Toner 16 | Amorphous resin 1 | Polyester | Alternating copolymer | 99 | 16.2 | — | 20.0 | 91.2 | 7.1 |
| Toner 17 | Amorphous resin 1 | Polyester | Alternating copolymer | 99 | 15.7 | — | 20.0 | 36.8 | 6.4 |
| Toner 18 | Amorphous resin 1 | Polyester | Alternating copolymer | 99 | 16.1 | — | 20.0 | 38.8 | 6.2 |
| Toner 19 | Amorphous resin 1 | Polyester | Alternating copolymer | 99 | 15.8 | — | 20.0 | 28.8 | 6.5 |
| Toner 20 | Amorphous resin 1 | Polyester | Alternating copolymer | 99 | 15.7 | — | 20.0 | 65.3 | 6.6 |
| Toner 21 | Amorphous resin 1 | Polyester | Alternating copolymer | 99 | 15.9 | — | 20.0 | 46.5 | 6.5 |
| Toner 22 | Amorphous resin 1 | Polyester | Alternating copolymer | 99 | 16.1 | — | 20.0 | 63.1 | 6.8 |
| Toner 23 | Amorphous resin 1 | Polyester | Alternating copolymer | 99 | 16.1 | — | 20.0 | 36.7 | 7.0 |
| Toner 24 | Amorphous resin 1 | Polyester | Alternating copolymer | 99 | 16.0 | — | 20.0 | 37.2 | 7.1 |
| Toner 25 | Amorphous resin 1 | Polyester | Alternating copolymer | 99 | 15.7 | — | 20.0 | 54.8 | 6.5 |
| Toner 26 | Amorphous resin 1 | Polyester | Alternating copolymer | 99 | 16.2 | — | 20.0 | 52.5 | 6.5 |
| Toner 27 | Amorphous resin 1 | Polyester | Alternating copolymer | 99 | 15.8 | — | 10.0 | 23.5 | 6.7 |
| Toner 28 | Amorphous resin 1 | Polyester | Alternating copolymer | 99 | 16.0 | — | 10.0 | 23.3 | 6.8 |
| Toner 29 | Amorphous resin 3 | Vinyl | Random copolymer | 99 | 35.8 | — | 70.0 | 58.1 | 7.3 |
| Toner 30 | Amorphous resin 3 | Vinyl | Random copolymer | 99 | 36.4 | — | 40.0 | 58.4 | 6.8 |
| Toner 31 | Amorphous resin 3 | Vinyl | Random copolymer | 99 | 35.9 | — | 15.0 | 58.2 | 6.5 |
| Toner 32 | Amorphous resin 3 | Vinyl | Random copolymer | 99 | 35.7 | — | 10.0 | 58.5 | 6.4 |
| Toner 33 | Amorphous resin 3 | Vinyl | Random copolymer | 99 | 35.9 | — | 10.0 | 58.2 | 6.5 |
| Toner 34 | Amorphous resin 3 | Vinyl | Random copolymer | 99 | 36.3 | — | 10.0 | 58.1 | 6.4 |
| Toner 35 | Amorphous resin 3 | Vinyl | Random copolymer | 99 | 36.0 | — | 10.0 | 58.6 | 6.4 |
| Toner 36 | Amorphous resin 3 | Vinyl | Random copolymer | 99 | 36.7 | — | 10.0 | 58.2 | 6.5 |
| Toner 37 | — | None | — | 0 | 0.0 | — | 20.0 | 58.2 | 6.5 |
| Toner 38 | Crystalline resin 1 | Crystalline polyester | Alternating copolymer | 91 | 35.9 | — | 10.0 | 58.2 | 7.2 |
| Toner 39 | Amorphous resin 3 | Vinyl | Random copolymer | 88 | 32.1 | — | 20.0 | 58.0 | 6.6 |
| Toner 40 | Amorphous resin 5<br>Amorphous resin 6 | Vinyl<br>Vinyl | Random copolymer<br>Random copolymer | 99 | 29.2 | 4.5 | 20.0 | 64.7 | 6.6 |
| Toner 41 | Amorphous resin 3 | Vinyl | Random copolymer | 99 | 33.5 | — | 9.0 | 58.4 | 6.6 |
| Toner 42 | Amorphous resin 1 | Polyester | Alternating copolymer | 99 | 15.7 | — | 10.0 | 18.5 | 6.5 |
| Toner 43 | Amorphous resin 1 | Polyester | Alternating copolymer | 99 | 16.1 | — | 10.0 | 94.2 | 7.2 |
| Toner 44 | Amorphous resin 1 | Polyester | Alternating copolymer | 99 | 15.8 | — | 10.0 | 54.3 | 6.5 |
| Toner 45 | Amorphous resin 1 | Polyester | Alternating copolymer | 99 | 16.2 | — | 10.0 | 18.3 | 6.3 |
| Toner 46 | Amorphous resin 1 | Polyester | Alternating copolymer | 99 | 16.2 | — | 10.0 | 52.0 | 6.3 |
| Toner 47 | Amorphous resin 1 | Polyester | Alternating copolymer | 99 | 16.1 | — | 10.0 | 28.4 | 6.5 |
| Toner 48 | Amorphous resin 3 | Vinyl | Random copolymer | 99 | 33.5 | — | 20.0 | 58.0 | 6.8 |

(In the Table 6, "(J/g)" represents Endothermic amount for endothermic peak associated with melting of polymer A (J/g).)

TABLE 7

| | | SP value of polymerizable monomer $(J/cm^3)^{0.5}$ | SP value of unit $(J/cm^3)^{0.5}$ |
|---|---|---|---|
| First polymerizable monomer | Behenyl acrylate | 17.69 | 18.25 |
| | Stearyl acrylate | 17.71 | 18.39 |
| | Myricyl acrylate | 17.65 | 18.08 |
| | Behenyl methacrylate | 17.61 | 18.10 |
| Second polymerizable monomer | Acrylonitrile | 22.75 | 29.43 |
| | Methacrylonitrile | 21.97 | 25.96 |
| | Acrylic acid | 22.66 | 28.72 |
| | 2-hydropropyl methacrylate | 22.05 | 24.12 |
| | Vinyl acetate | 18.31 | 21.60 |
| | Methyl acrylate | 18.31 | 21.60 |
| | Acrylamide | 29.13 | 39.25 |
| | Urethane group-containing monomer | 21.91 | 23.79 |
| | Urea group-containing monomer | 20.86 | 21.74 |
| Third polymerizable monomer | Styrene | 17.94 | 20.11 |
| | Methyl methacrylate | 18.27 | 20.31 |

Examples 1 to 36 and Comparative Examples 1 to 12

Evaluations were performed using toners 1 to 48 in the combinations shown in Table 8. The results of the evaluations are given in Table 8.

The evaluation methods and evaluation criteria used in the present invention are described in the following.

<1. Evaluation of Transferability>

An LBP-712Ci (Canon, Inc.), which is a commercial laser printer equipped with an intermediate transfer belt as the intermediate transfer member, was used for the image-forming device. This was modified to provide a variable secondary transfer bias and a process speed of 240 mm/sec. A 040H toner cartridge (cyan) (Canon, Inc.), which is a commercial process cartridge, was used. The product toner was removed from within the cartridge, which, after cleaning with an air blower, was filled with 165 g of the toner to be evaluated.

The product toner was removed at each of the yellow, magenta, and black stations, and the evaluations were performed with the yellow, magenta, and black cartridges installed, but with the remaining toner detection mechanism inactivated.

<1-1. Evaluation of Initial Transferability in Normal-Temperature, Normal-Humidity Environment (N/N Initial Transferability)>

The aforementioned process cartridge and modified laser printer and the evaluation paper (GF-C081 (Canon, Inc.), A4, 81.4 g/m$^2$) were held for 48 hours in a normal-temperature, normal-humidity environment (25° C./50% RH, referred to in the following as the N/N environment).

The secondary transfer bias in the modified laser printer was set at a potential that made the potential difference 300 V smaller than with the normal potential, and a full solid image was output in an N/N environment. The machine was stopped during transfer from the intermediate transfer member to the paper, and the toner laid-on level M1 (mg/cm$^2$) on the intermediate transfer member prior to the transfer step and the toner laid-on level M2 (mg/cm$^2$) on the intermediate transfer member after the transfer step were measured. The transfer efficiency (%) was calculated from the obtained toner laid-on levels using (M1−M2)×100/M1.

This evaluation was performed by changing the potential difference in 50 V steps and measuring the transfer efficiency at each secondary transfer bias.

The transferability was evaluated using the evaluation criteria given below. A better transferability results in the occurrence of a good transfer efficiency even as the secondary transfer bias declines. As a result, the toner on the drum can then be faithfully transferred onto the paper and a high quality image can be obtained.

(Evaluation Criteria for Transferability)

A: The transfer efficiency is at least 98% even at a potential that is 200 V lower than normal.

B: The transfer efficiency is at least 98% even at a potential that is 100 V lower than normal.

C: The transfer efficiency is at least 98% at the normal potential.

D: The transfer efficiency is less than 98% at the normal potential.

<1-2. Evaluation of Transferability after Durability Test in Normal-Temperature, Normal-Humidity Environment (N/N Transferability Post-Durability Test)>

After the evaluation of the initial transferability in a normal-temperature, normal-humidity environment, 25,000 prints of an image having a print percentage of 0.5% were continuously output on the evaluation paper in the N/N environment. After standing still for 24 hours in the same environment, the same evaluation was performed as in the evaluation of the initial transferability in the normal-temperature, normal-humidity environment.

The evaluation was performed using the transferability evaluation criteria given above to provide an evaluation of the transferability after the durability test in the normal-temperature, normal-humidity environment.

<1-3. Evaluation of Initial Transferability in High-Temperature, High-Humidity Environment (H/H Initial Transferability)>

The aforementioned process cartridge and modified laser printer and the evaluation paper (GF-0081 (Canon, Inc.), A4, 81.4 g/m$^2$) were held for 48 hours in a high-temperature, high-humidity environment (30° C./80% RH, referred to in the following as the H/H environment). The same evaluation was then carried out as in the evaluation of the initial transferability in a normal-temperature, normal-humidity environment.

The evaluation was performed using the transferability evaluation criteria given above to provide an evaluation of the initial transferability in the high-temperature, high-humidity environment.

<1-4. Evaluation of Initial Transferability after Storage (Initial Transferability Post-Storage)>

The aforementioned process cartridge was held at quiescence for 30 days in a cyclic high-temperature, high-humidity environment (The following was repeated: the temperature was raised over 11 hours from 25° C. to 50° C., holding was carried out for 1 hour at 55° C., the temperature was reduced over 11 hours to 25° C., and holding was carried out for 1 hour at 25° C. The humidity was adjusted to 95% RH).

The process cartridge provided by this holding step, the aforementioned modified laser printer, and the evaluation paper (GF-0081 (Canon, Inc.), A4, 81.4 g/m$^2$) were held for 48 hours in a normal-temperature, normal-humidity environment (25° C./50% RH, referred to in the following as the N/N environment). The same evaluation was then performed as for the evaluation of the initial transferability in a normal-temperature, normal-humidity environment.

The evaluation was performed using the transferability evaluation criteria given above to provide an evaluation of the initial transferability post-storage.

<2. Low-Temperature Fixability>

An LBP-712Ci (Canon, Inc.), which is a commercial laser printer, was used for the image-forming device. This had been modified to enable it to operate even with the fixing unit removed. A 040H toner cartridge (cyan) (Canon, Inc.), which is a commercial process cartridge, was also used. The product toner was removed from within the cartridge, which, after cleaning with an air blower, was filled with 165 g of the toner to be evaluated. The product toner was removed at each of the yellow, magenta, and black stations, and the evaluations were performed with the yellow, magenta, and black cartridges installed, but with the remaining toner amount detection mechanism inactivated.

The aforementioned process cartridge and modified laser printer and the transfer paper (Fox River Bond (90 g/m$^2$)) were held for 48 hours in a normal-temperature, normal-humidity environment (23° C./50% RH, referred to below as the N/N environment). The process cartridge was then installed in the laser printer and an unfixed image, having an image pattern in which a 10 mm×10 mm square image was disposed at 9 points uniformly over the transfer paper as a whole, was output. The toner laid-on level on the transfer paper was brought to 0.80 mg/cm$^2$ and the fixing onset temperature was evaluated.

The fixing unit in the LBP-712Ci was removed to the outside and was configured to also operate outside the laser printer, and this external fixing unit was used as the fixing unit. Fixing was carried out using this external fixing unit and a process speed of 240 mm/sec, with the fixation temperature being raised in 10° C. increments from a temperature of 100° C.

The fixed image was rubbed with lens cleaning paper ("Dusper (R)" (Ozu Paper Co., Ltd.)) under a load of 50 g/cm$^2$. The fixing onset temperature was taken to be the temperature at which the percentage decline in density pre-versus-post-rubbing was equal to or less than 20%, and the low-temperature fixability was evaluated using the following criteria. The results of the evaluation are given in Table 8.

(Evaluation Criteria for Low-Temperature Fixability)

A: The fixing onset temperature is equal to or less than 100° C.

B: The fixing onset temperature is 110° C.

C: The fixing onset temperature is 120° C.

D: The fixing onset temperature is equal to or greater than 130° C.

TABLE 8

| | | N/N initial transferability | N/N transferability post-durability test | H/H initial transferability | Initial transferability post-storage | Low-temperature fixability |
|---|---|---|---|---|---|---|
| Example 1 | Toner 1 | A | A | A | A | A |
| Example 2 | Toner 2 | A | A | A | A | A |
| Example 3 | Toner 3 | A | A | A | A | A |
| Example 4 | Toner 4 | A | A | A | A | A |
| Example 5 | Toner 5 | A | A | A | A | A |
| Example 6 | Toner 6 | A | A | A | A | A |
| Example 7 | Toner 7 | A | A | A | A | A |
| Example 8 | Toner 8 | A | B | A | A | A |
| Example 9 | Toner 9 | A | B | A | A | A |
| Example 10 | Toner 10 | A | A | A | A | A |
| Example 11 | Toner 11 | A | A | A | A | A |
| Example 12 | Toner 12 | A | A | A | A | B |
| Example 13 | Toner 13 | B | B | B | B | A |
| Example 14 | Toner 14 | A | A | A | A | C |
| Example 15 | Toner 15 | A | A | A | A | A |
| Example 16 | Toner 16 | B | B | B | C | A |
| Example 17 | Toner 17 | A | A | A | A | C |
| Example 18 | Toner 18 | A | A | A | A | A |
| Example 19 | Toner 19 | B | B | B | B | C |
| Example 20 | Toner 20 | A | A | A | A | A |
| Example 21 | Toner 21 | A | A | A | A | A |
| Example 22 | Toner 22 | A | A | A | A | B |
| Example 23 | Toner 23 | A | A | A | A | C |
| Example 24 | Toner 24 | A | A | A | A | C |
| Example 25 | Toner 25 | A | A | A | A | A |
| Example 26 | Toner 26 | B | B | B | B | A |
| Example 27 | Toner 27 | A | A | A | A | C |
| Example 28 | Toner 28 | A | A | A | A | C |
| Example 29 | Toner 29 | A | A | B | B | B |
| Example 30 | Toner 30 | A | A | A | A | A |
| Example 31 | Toner 31 | A | A | A | A | A |
| Example 32 | Toner 32 | A | A | A | C | A |
| Example 33 | Toner 33 | B | B | B | C | A |
| Example 34 | Toner 34 | B | B | B | C | A |
| Example 35 | Toner 35 | B | B | C | C | A |
| Example 36 | Toner 36 | C | C | C | C | A |
| Comparative Example 1 | Toner 37 | B | D | D | B | A |
| Comparative Example 2 | Toner 38 | D | D | D | D | A |
| Comparative Example 3 | Toner 39 | A | D | D | A | A |
| Comparative Example 4 | Toner 40 | A | D | D | A | A |
| Comparative Example 5 | Toner 41 | D | D | D | D | A |
| Comparative Example 6 | Toner 42 | A | A | A | B | D |
| Comparative Example 7 | Toner 43 | D | D | D | D | A |
| Comparative Example 8 | Toner 44 | D | D | D | D | A |
| Comparative Example 9 | Toner 45 | A | A | A | B | D |
| Comparative Example 10 | Toner 46 | D | D | D | D | A |
| Comparative Example 11 | Toner 47 | D | D | D | D | A |
| Comparative Example 12 | Toner 48 | D | D | D | D | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113141, filed, Jun. 13, 2018, and Japanese Patent Application No. 2019-075019 filed, Apr. 10, 2019, which are hereby incorporated by reference herein in their entirety.

What is claimed is:

1. A toner, comprising a toner particle which comprises a toner core containing a binder resin, and a shell layer;

the binder resin containing a polymer A obtained by polymerization of a composition containing a first polymerizable monomer and a second polymerizable monomer that is different from the first polymerizable monomer, the first polymerizable monomer being at least one selected from the group consisting of (meth) acrylate esters having an alkyl group having 18 to 36 carbon atoms and the second polymerizable monomer being at least one selected from the group consisting of formulae (A) and (B)

(A)

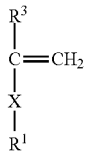

(B)

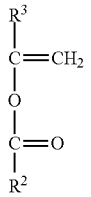

where X represents a single bond or an alkylene group having 1 to 6 carbon atoms, $R^1$ is a nitrile group (—C≡N), amide group (—C(=O)$NHR^{10}$ ($R^{10}$ is a hydrogen atom or an alkyl group having 1 to 4 carbon atoms)), hydroxy group, —$COOR^{11}$ ($R^{11}$ is an alkyl group having 1 to 6 carbon atoms or a hydroxyalkyl group having 1 to 6 carbon atoms), urethane group (—$NHCOOR^{12}$ ($R^{12}$ is an alkyl group having 1 to 4 carbon atoms)), urea group (—NH—C(=O)—$N(R^{13})_2$ ($R^{13}$ independently is a hydrogen atom or an alkyl group having 1 to 6 carbon atoms)), —$COO(CH_2)_2NHCOOR^{14}$ ($R^{14}$ is an alkyl group having 1 to 4 carbon atoms), or —COO$(CH_2)_2$—NH—C(=O)—$N(R^{15})_2$ ($R^{15}$ independently is a hydrogen atom or an alkyl group having 1 to 6 carbon atoms), $R^2$ is an alkyl group having 1 to 4 carbon atoms, and $R^3$ is a hydrogen atom or methyl group; and the shell layer comprising at least one amorphous resin selected from the group consisting of homopolymers, alternating copolymers, and random copolymers, the amorphous resin being at least one selected from the group consisting of polyester resins, polyurethane resins, melamine resins, vinyl resins, and urea resins, wherein the content of the first polymerizable monomer in the composition is 5.0 to 60.0 mol % with reference to the total number of moles of all the polymerizable monomer in the composition, the content of the second polymerizable monomer in the composition is 20.0 to 95.0 mol % with reference to the total number of moles of all the polymerizable monomer in the composition, $0.60 \leq (SP_{22}-SP_{12}) \leq 15.00$ where $SP_{12}$ $(J/cm^3)^{0.5}$ is the SP value of the first polymerizable monomer and $SP_{22}$ $(J/cm^3)^{0.5}$ is the SP value of the second polymerizable monomer, the shell layer is observed over at least 90% of the circumference of the toner cross section in an image of the toner cross section observed with a transmission electron microscope (TEM), and $SP_{S1}-SP_{S2} \leq 3.0$ is satisfied when the shell layer comprises at least two amorphous resins, where the resin having the highest SP value of the resins comprising the shell layer is resin S1 and has the SP value $SP_{S1}$ $(J/cm^3)^{0.5}$, and the resin having the lowest SP value of the resins comprising the shell layer is resin S2 and has the SP value $SP_{S2}$ $(J/cm^3)^{0.5}$.

2. The toner according to claim 1, wherein the content of the second polymerizable monomer in the composition is 40.0 to 95.0 mol % with reference to the total number of moles of all the polymerizable monomer in the composition.

3. The toner according to claim 1, wherein the first polymerizable monomer is at least one selected from the group consisting of (meth)acrylate esters having a linear alkyl group having 18 to 36 carbon atoms.

4. The toner according to claim 1, wherein the acid value of the polymer A is not more than 30 mg KOH/g.

5. The toner according to claim 1, wherein $R^1$ is said nitrile group (—C≡N), amide group (—C(=O)$NHR^{10}$), hydroxy group, —$COOR^{11}$, —COO$(CH_2)_2NHCOOR^{14}$, or —$COO(CH_2)_2$—NH—C(=O)—$N(R^{15})_2$.

6. The toner according to claim 1, wherein the composition further comprises a third polymerizable monomer that is different from both the first and second polymerizable monomers, and the third polymerizable monomer is at least one polymerizable monomer selected from the group consisting of styrene, methyl methacrylate, and methyl acrylate.

7. The toner according to claim 1, wherein the endothermic quantity for the endothermic peak associated with the melting of the polymer A is 20 to 100 (J/g) when the toner is subjected to measurement by differential scanning calorimetry.

8. The toner according to claim 1, wherein the charge decay constant of the polymer A is not more than 100.

9. The toner according to claim 1, wherein the shell layer is constituted of one species of amorphous resin.

10. The toner according to claim 1, wherein the thickness of the shell layer is 2 to 100 nm in an image of the toner cross section observed with a transmission electron microscope (TEM).

11. The toner according to claim 1, wherein polymer A is a vinyl polymer.

12. The toner according to claim 1, wherein the acid value of polymer A is not more than 30 mg KOH/g.

13. The toner according to claim 1, wherein the toner contains a wax, and $0.2 \times A \leq W \leq A$ when W mass parts is the content of the wax, A mass parts is the content of the first monomer unit, and the content of the polymer A in the toner is 100 mass parts.

* * * * *